US008664497B2

(12) United States Patent
Taylor

(10) Patent No.: US 8,664,497 B2
(45) Date of Patent: Mar. 4, 2014

(54) DOUBLE KEYBOARD PIANO SYSTEM

(75) Inventor: Christopher Taylor, Middleton, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 218 days.

(21) Appl. No.: 13/301,974

(22) Filed: Nov. 22, 2011

(65) Prior Publication Data

US 2013/0125727 A1 May 23, 2013

(51) Int. Cl.
*G10H 3/00* (2006.01)

(52) U.S. Cl.
USPC ..... 84/2; 84/3; 84/170; 84/615; 84/653

(58) Field of Classification Search
USPC ..... 84/2–23, 170–172, 615, 653
See application file for complete search history.

(56) References Cited

U.S. PATENT DOCUMENTS 1,613,400 A * 1/1927 McAleavey ..... 84/477 R
2,784,633 A * 3/1957 Hess ..... 84/171
3,749,807 A 7/1973 Adachi
3,825,668 A 7/1974 Okamoto
3,886,834 A 6/1975 Okamoto
4,223,584 A 9/1980 Nakada et al.
4,226,154 A * 10/1980 Easler ..... 84/686
4,592,262 A 6/1986 Yang
4,744,281 A * 5/1988 Isozaki ..... 84/602
4,939,969 A * 7/1990 Taguchi et al. ..... 84/719
5,507,215 A * 4/1996 Lin ..... 84/423 R
5,565,635 A * 10/1996 Kaneko et al. ..... 84/20
5,637,822 A * 6/1997 Utsumi et al. ..... 84/645
6,069,310 A * 5/2000 James ..... 84/645
6,288,317 B1 * 9/2001 Willis ..... 84/600
6,689,947 B2 2/2004 Ludwig
6,751,439 B2 * 6/2004 Tice et al. ..... 434/350
6,921,856 B2 * 7/2005 Koseki ..... 84/603
7,355,109 B2 * 4/2008 Muramatsu et al. ..... 84/13
7,390,958 B2 * 6/2008 Knudsen ..... 84/645
7,405,355 B2 * 7/2008 Both et al. ..... 84/645
7,453,039 B2 * 11/2008 Ramstein ..... 84/645
7,501,568 B2 * 3/2009 Uehara ..... 84/600
7,742,832 B1 * 6/2010 Feldman et al. ..... 700/94
7,767,901 B2 * 8/2010 Contois et al. ..... 84/645
7,820,902 B2 * 10/2010 Furukawa et al. ..... 84/609
7,947,889 B2 * 5/2011 Usa et al. ..... 84/615
2001/0007219 A1 * 7/2001 Uehara et al. ..... 84/609
2001/0007220 A1 7/2001 Koseki et al.

(Continued)

OTHER PUBLICATIONS

Barron, Let's Play Two: Singular Piano, The New York Times, Jul. 15, 2007.

*Primary Examiner* — David S. Warren
(74) *Attorney, Agent, or Firm* — Bell & Manning, LLC

(57) ABSTRACT

A double keyboard piano system is provided. The double keyboard piano system may include a first automatic player piano, a second automatic player piano, and a double keyboard console including a first keyboard and a second keyboard mounted above the first keyboard. The first automatic player piano is in communication with the double keyboard console to receive a first signal including first information describing a first key for the first automatic player piano to automatically play based on a first key of the first keyboard being played, and the second automatic player piano is in communication with the double keyboard console to receive a second signal including second information describing a second key for the second automatic player piano to automatically play based on a second key of the second keyboard being played.

20 Claims, 18 Drawing Sheets

(56) References Cited

U.S. PATENT DOCUMENTS

| | | | | |
|---|---|---|---|---|
| 2002/0046269 | A1* | 4/2002 | James | 709/223 |
| 2005/0005761 | A1* | 1/2005 | Knudsen | 84/645 |
| 2005/0235801 | A1* | 10/2005 | Muramatsu et al. | 84/13 |
| 2008/0041217 | A1* | 2/2008 | Knudsen | 84/464 R |
| 2009/0084248 | A1* | 4/2009 | Furukawa et al. | 84/609 |
| 2009/0100979 | A1* | 4/2009 | Furukawa et al. | 84/13 |
| 2009/0282962 | A1 | 11/2009 | Jones et al. | |
| 2010/0043619 | A1* | 2/2010 | Stahnke | 84/21 |
| 2010/0269665 | A1 | 10/2010 | Jones et al. | |
| 2010/0326260 | A1 | 12/2010 | Komatsu et al. | |
| 2013/0125727 | A1* | 5/2013 | Taylor | 84/21 |

* cited by examiner

DOUBLE KEYBOARD PIANO SYSTEM

BACKGROUND

In the early twentieth century Emmanuel Moor pioneered the concept of a double-manual piano, an instrument that uses a normal piano's basic means of tone production, but which has at the front end two keyboards stacked in the manner of some harpsichords or organs. Moor persuaded a number of piano makers to build his device, including Steinway & Sons, who produced a single double-manual piano in 1929. Although these instruments aroused considerable curiosity, they did not catch on to any great degree, and since about 1940 none have been manufactured. As a result, very few remain today. Because of their mechanical complexity, the double-manual pianos still in existence are difficult to maintain, and accordingly, may be difficult or impossible to play. Moor's mechanism, which connects the second keyboard to the same set of hammers controlled by the first keyboard, is also inherently balky and heavy in a way that a pianist can readily feel under their fingers and that requires significant effort to transport.

SUMMARY

In an example embodiment, a double keyboard piano system is provided. The double keyboard piano system may include a first automatic player piano, a second automatic player piano, and a double keyboard console including a first keyboard and a second keyboard mounted above the first keyboard. The first automatic player piano is in communication with the double keyboard console to receive a first signal including first information describing a first key for the first automatic player piano to automatically play based on a first key of the first keyboard being played, and the second automatic player piano is in communication with the double keyboard console to receive a second signal including second information describing a second key for the second automatic player piano to automatically play based on a second key of the second keyboard being played.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
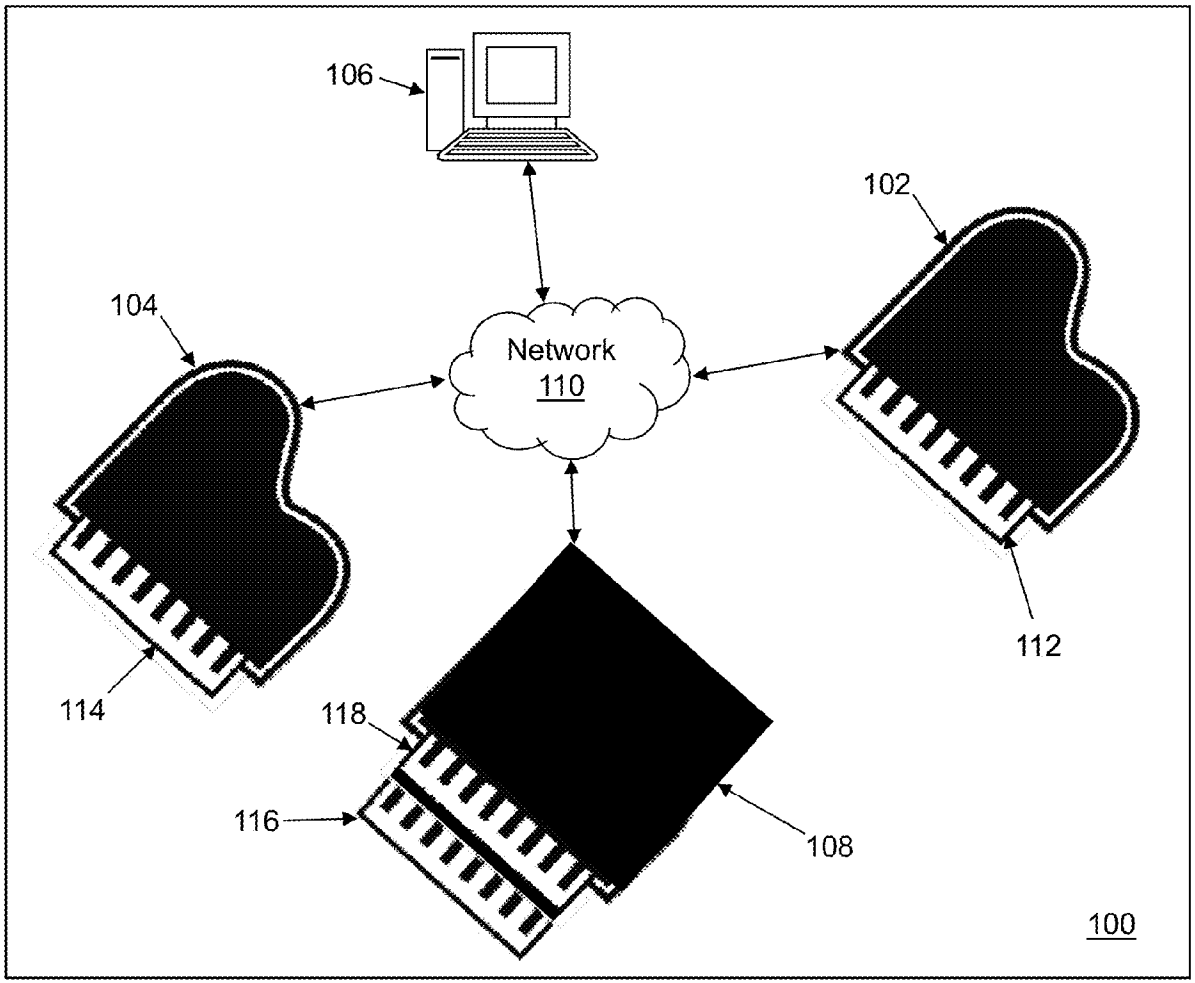
FIG. 1 depicts a block diagram of a double keyboard piano system in accordance with an illustrative embodiment.

With reference to FIG. 1, a block diagram of a double keyboard piano system 100 is shown in accordance with an illustrative embodiment. In an illustrative embodiment, double keyboard piano system 100 includes a first automatic player piano 102, a second automatic player piano 104, a controller 106, a double keyboard console 108, and a network 110. The components of double keyboard piano system 100 may be positioned in a single location, a single facility, and/or may be remote from one another.

Network 110 may include one or more networks of the same or different types. Network 110 can be any type of wired and/or wireless public or private network including a cellular network, a local area network, a wide area network such as the Internet, etc. Network 110 further may be comprised of subnetworks and consist of any number of devices. Network 110 further may comprise direct connections between first automatic player piano 102, second automatic player piano 104, controller 106, and double keyboard console 108. For example, wired or wireless connectors may connect double keyboard console 108 to controller 106, and wired or wireless connectors may connect first automatic player piano 102 and second automatic player piano 104 to controller 106.

First automatic player piano 102 and second automatic player piano 104 may be the same or different types of automatic player pianos. First automatic player piano 102 and second automatic player piano 104 are acoustic-tone-producing, electronically controlled pianos. For example, first automatic player piano 102 and/or second automatic player piano 104 may comprise a Yamaha Disklavier™ player piano. First automatic player piano 102 and/or second automatic player piano 104 may be upright pianos, baby grand pianos, or grand pianos. First automatic player piano 102 may include a first plurality of controlled keys 112 that include black keys and white keys as understood by a person of skill in the art according to the type of piano. Second automatic player piano 104 may include a second plurality of controlled keys 114 that also include black keys and white keys as understood by a person of skill in the art according to the type of piano.

Double keyboard console 108 may include a first keyboard 116 and a second keyboard 118 both of which include black keys and white keys as understood by a person of skill in the art according to the type of piano. Double keyboard console 108 does not directly produce sound, but transmits signals to first automatic player piano 102 and/or second automatic player piano 104 either directly or indirectly through controller 106. The black and white keys of first keyboard 116 are used to control the first plurality of controlled keys 112 and/or the second plurality of controlled keys 114. The black and white keys of second keyboard 118 are used to control the second plurality of controlled keys 114 and/or the first plurality of controlled keys 112. The second plurality of controlled keys 114 may be arranged and may operate in a manner similar to the first plurality of controlled keys 112 though this is not required. Similarly, the black and white keys of first keyboard 116 may be arranged and may operate in a manner similar to the first plurality of controlled keys 112, and the black and white keys of second keyboard 118 may be arranged and may operate in a manner similar to the second plurality of controlled keys 114 though again this is not required.

In the illustrative embodiment, controller 106 receives signals from double keyboard console 108 indicating depression of one or more keys of first keyboard 116, depression of one or more keys of second keyboard 118, and/or use of one or more pedals of double keyboard console 108 by the pianist playing double keyboard console 108. Controller 106 processes the signals and sends information associated with the processed signals to one or more of first automatic player piano 102 and second automatic player piano 104. In another illustrative embodiment, double keyboard piano system 100 need not include controller 106. In this illustrative embodiment, double keyboard console 108 sends signals directly to one or more of first automatic player piano 102 and second automatic player piano 104. First automatic player piano 102 and/or second automatic player piano 104 may include electromechanical solenoids to control the playing of keys and to control use of the pedals based on the signals received from controller 106 and/or double keyboard console 108. Controller 106 and/or double keyboard console 108 may send the signals based on a protocol understood by each device. For example, in an illustrative embodiment, the musical instrument digital interface (MIDI) protocol may be used to define the format and the content of the signals as understood by a person of skill in the art.

Figure 2:
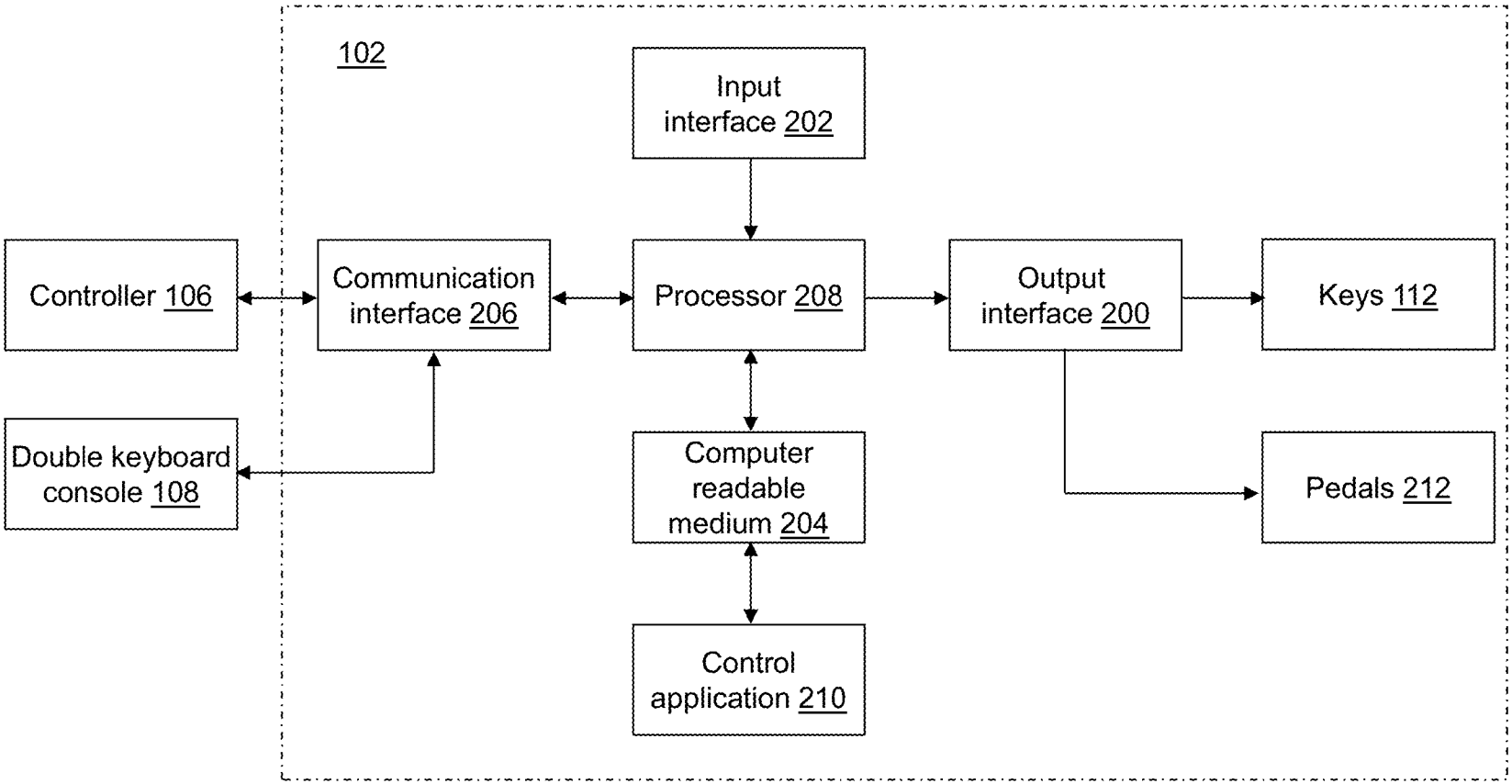
FIG. 2 depicts a block diagram of an automatic player piano of the double keyboard piano system of FIG. 1 in accordance with an illustrative embodiment.

With reference to FIG. 2, a block diagram of first automatic player piano 102 is shown in accordance with an illustrative embodiment. Second automatic player piano 104 may include the same or similar components. First automatic player piano 102 may include an output interface 200, an input interface 202, a computer-readable medium 204, a communication interface 206, a processor 208, a controller application 210, the first plurality of controlled keys 112, and a plurality of controlled pedals 212. Different and additional or fewer components may be incorporated into first automatic player piano 102 and/or second automatic player piano 104. Of course, second automatic player piano 104 instead includes the second plurality of controlled keys 114.

Output interface 200 provides an interface for controlling operation of the first plurality of controlled keys 112 and the plurality of controlled pedals 212. First automatic player piano 102 and/or second automatic player piano 104 may have one or more output interfaces that use the same or a different interface technology.

Input interface 202 provides an interface for receiving information from the user for entry into first automatic player piano 102 and/or second automatic player piano 104 as known to those skilled in the art. Input interface 202 may use various input technologies including, but not limited to, a keyboard, a pen and touch screen, a mouse, a track ball, a touch screen, a keypad, one or more buttons, etc. to allow the user to enter information into first automatic player piano 102 and/or second automatic player piano 104 or to make selections presented in a user interface displayed on a display electrically connected to first automatic player piano 102 and/or second automatic player piano 104, for example, through input interface 202 or communication interface 206. First automatic player piano 102 and/or second automatic player piano 104 may have one or more input interfaces that use the same or a different input interface technology.

Computer-readable medium 204 is an electronic holding place or storage for information so that the information can be accessed by processor 208 as known to those skilled in the art. Computer-readable medium 204 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., compact disk (CD), digital versatile disk (DVD), . . . ), smart cards, flash memory devices, etc. First automatic player piano 102 and/or second automatic player piano 104 may have one or more computer-readable media that use the same or a different memory media technology. First automatic player piano 102 and/or second automatic player piano 104 also may have one or more drives that support the loading of a memory media such as a CD or DVD.

Communication interface 206 provides an interface for receiving and transmitting data between devices using various protocols, transmission technologies, and media as known to those skilled in the art. Communication interface 206 may support communication using various transmission media that may be wired or wireless. First automatic player piano 102 and/or second automatic player piano 104 may have one or more communication interfaces that use the same or a different communication interface technology. Data and messages may be transferred between first automatic player piano 102 and controller 106 using communication interface 206. Data and messages also may be transferred between first automatic player piano 102 and double keyboard console 108 using communication interface 206. Similarly, second automatic player piano 104 may include communication interface 206 to support communication with controller 106 and/or double keyboard console 108.

Processor 208 executes instructions as known to those skilled in the art. The instructions may be carried out by a special purpose computer, logic circuits, or hardware circuits. Thus, processor 208 may be implemented in hardware, firmware, or any combination of these methods and/or in combination with software. The term "execution" is the process of running an application or the carrying out of the operation called for by an instruction. The instructions may be written using one or more programming language, scripting language, assembly language, etc. Processor 208 executes an instruction, meaning that it performs/controls the operations called for by that instruction. Processor 208 operably couples with output interface 200, with input interface 202, with computer-readable medium 204, and with communication interface 206 to receive, to send, and to process information. Processor 208 may retrieve a set of instructions from a permanent memory device and copy the instructions in an executable form to a temporary memory device that is generally some form of RAM. First automatic player piano 102 and/or second automatic player piano 104 may include a plurality of processors that use the same or a different processing technology.

Control application 210 performs operations associated with processing the signals received from controller 106 and/or double keyboard console 108 and controlling the operation of the first plurality of controlled keys 112 and the plurality of controlled pedals 212 based on the processing of the signals and the type of output interface 200 that controls the first plurality of controlled keys 112 and the plurality of controlled pedals 212. The operations may be implemented using hardware, firmware, software, or any combination of these methods. With reference to the example embodiment of FIG. 2, control application 210 is implemented in software (comprised of computer-readable and/or computer-executable instructions) stored in computer-readable medium 204 and accessible by processor 208 for execution of the instructions that embody the operations of control application 210. Control application 210 may be written using one or more programming languages, assembly languages, scripting languages, etc.

Figure 3:
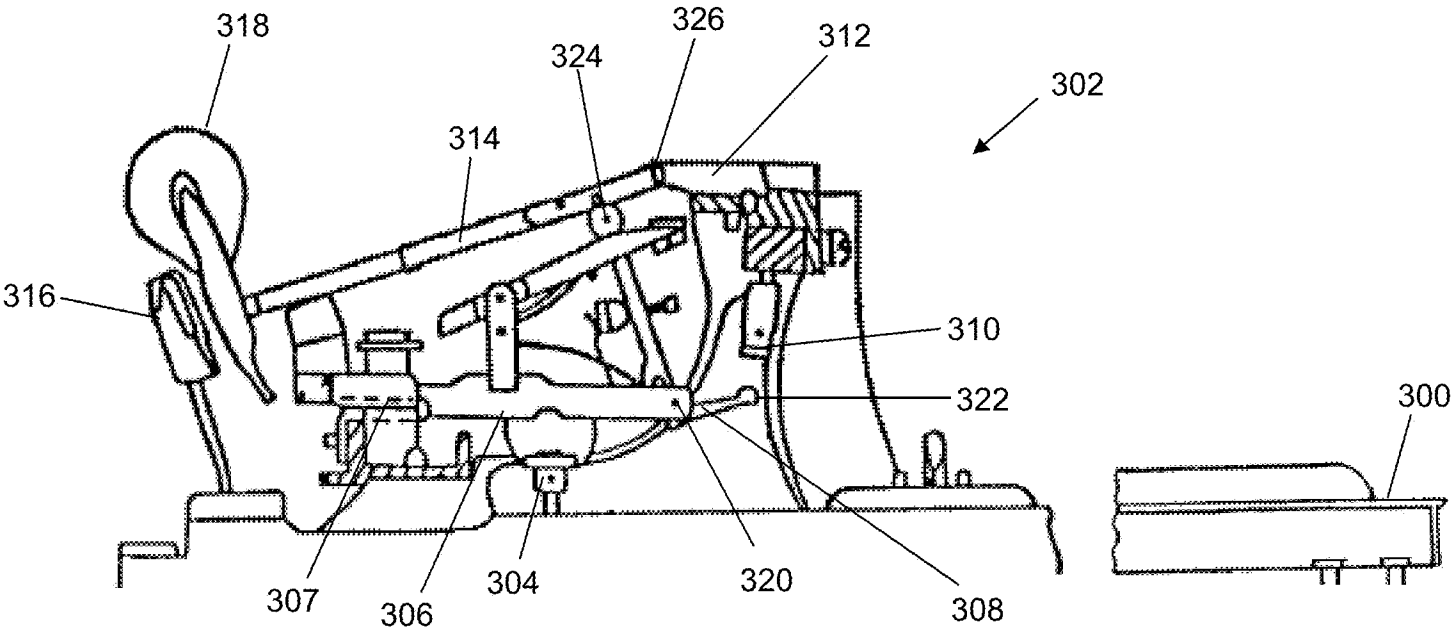
FIG. 3 depicts a side view of a piano action mechanism in accordance with an illustrative embodiment.

With reference to FIG. 3, a key 300 of the first plurality of controlled keys 112 is shown in accordance with an illustrative embodiment. Similarly, key 300 may be included in the second plurality of controlled keys 114. Key 300 is mounted to an action mechanism 302 that is in turn positioned to strike a string (not shown) when key 300 is depressed by the pianist. As used in this disclosure, the term "mount" includes join, unite, connect, couple, associate, insert, hang, hold, affix, attach, fasten, bind, paste, secure, bolt, screw, rivet, solder, weld, glue, and other like terms. The phrases "mounted on" and "mounted to" include any interior or exterior portion of the element referenced. These phrases also encompass direct mounting (in which the referenced elements are in direct contact) and indirect mounting (in which the referenced elements are not in direct contact and are mounted together via intermediate elements). A variety of action mechanisms are known to a person of skill in the art. Thus, action mechanism 302 is shown for illustration only and is not intended to limit the application in any manner.

In the illustrative embodiment, action mechanism 302 is mounted to key 300 through a capstan screw 304 and includes a wippen 306, a wippen flange rail 307, a jack 308, a regulating button 310, a hammer flange rail 312, a hammer shank 314, a back check 316, and a hammer 318. Depression of key 300 causes capstan 304 to move upward which in turn causes wippen 306 to move upward and rotate about a first endpoint (not shown) of wippen 306 that is mounted for rotation to wippen flange rail 307. Thus, action mechanism 302 is rotatable about the first endpoint of wippen 306. Jack 308 is mounted for rotation about a second endpoint 320 of wippen 306. As second endpoint 320 of wippen 306 is moved upward with the rotation caused by movement of capstan 304, a first jack endpoint 322 of jack 308 moves upward until it contacts regulating button 310 releasing a jack knuckle 324. Jack knuckle 324 moves upward and rotates hammer shank 314 about a flange endpoint 326 of hammer flange rail 312 thereby rotating hammer 318 relative to flange endpoint 326. Hammer 318 strikes the string to generate the acoustic piano tone associated with key 300. After striking the string, hammer 318 rebounds and is gently received by back check 316 on the way to the rest position after key 300 is released. Use of directional terms such as "up", "down", "upward", "downward", "left', "right", "front", "back", etc. is based on the arrangements illustrated in the figures. Of course, other arrangement directions may be used without limitation.

Processor 208 executing control application 210 may determine the key(s) or hammer(s) of the first plurality of controlled keys 112 to be moved based on the information included in the signals received from controller 106. First automatic player piano 102 and/or second automatic player piano 104 may comprise an array of solenoid-operated key actuators and a servo-controller configured to trigger movement of one or more keys of the first plurality of controlled keys 112 such as key 300. Plunger position sensors may provide plunger position signals representative of the current plunger positions to the servo-controller. The servo-controller determines the magnitude of a driving pulse signal to generate a target velocity for moving the plunger, and supplies the driving pulse signal to the solenoid-operated key actuator associated with the one or more keys to be played. When the solenoid-operated key actuator moves key 300, key 300 actuates the action mechanism 302 causing hammer 318 to strike the string. Thus, in the illustrative embodiment, output interface 200 comprises the array of solenoid-operated key actuators and the servo-controller.

The plurality of controlled pedals 212 may vary as understood by a person of skill in the art. In an illustrative embodiment, where first automatic player piano 102 and/or second automatic player piano 104 comprise a grand piano, the plurality of controlled pedals 212 may include three pedals: an una corda pedal, a sostenuto pedal, and a damper pedal arranged from left to right, respectively. In other illustrative embodiments, a fewer or a greater number of pedals may be used. In the illustrative embodiment, the una corda pedal shifts the entire action/keyboard assembly to the right so that the hammers hit two of the three strings for each note played. In the illustrative embodiment, the sostenuto pedal raises any damper already raised at the moment the sostenuto pedal is depressed making it possible to sustain selected notes while the player's hands are free to play additional notes that are not sustained. In the illustrative embodiment, the damper pedal lifts the dampers from all keys, sustaining all played notes, and alters the overall tone by allowing all strings, including those not directly played, to reverberate.

Figure 4:
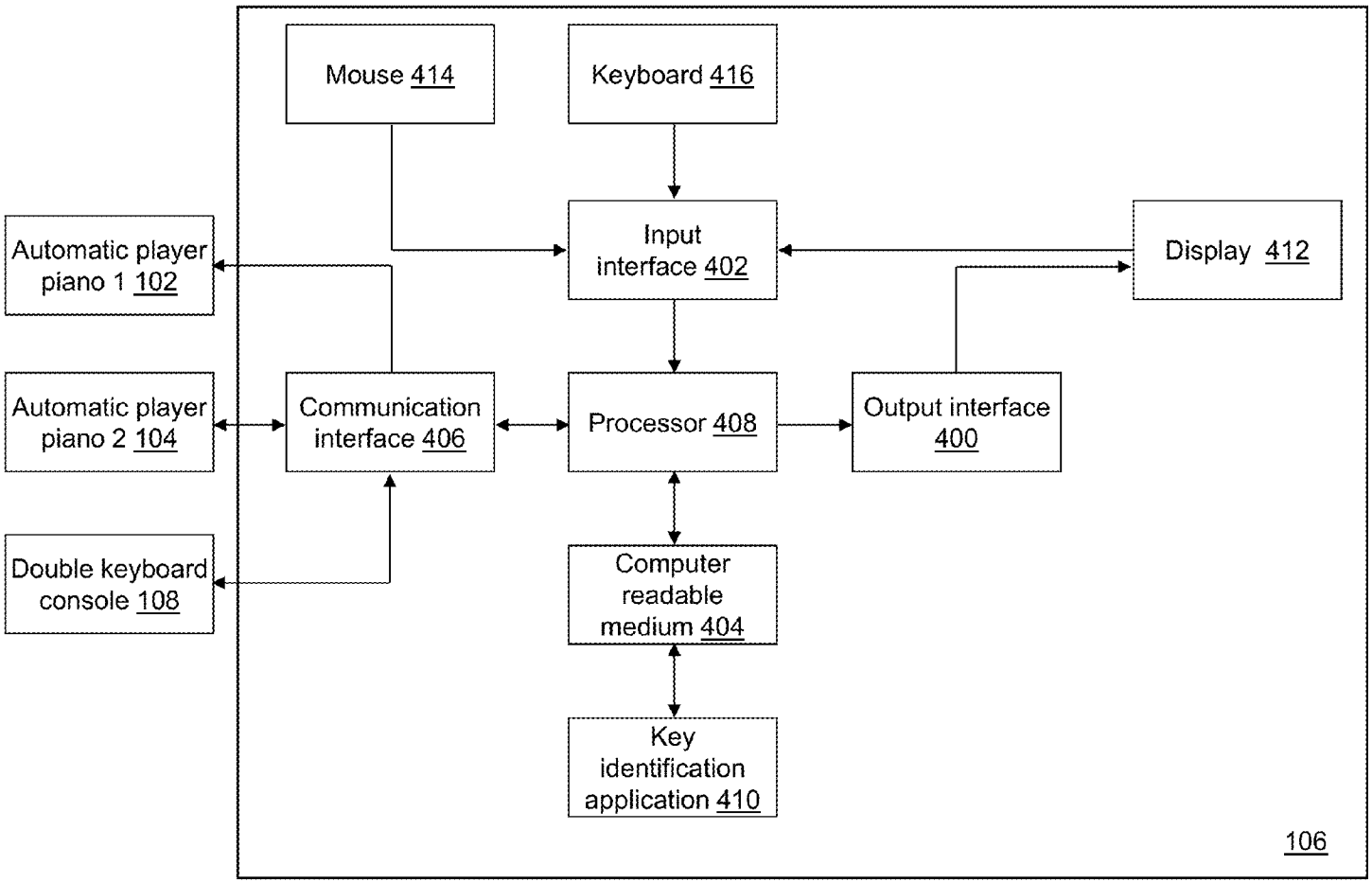
FIG. 4 depicts a block diagram of a controller of the double keyboard piano system of FIG. 1 in accordance with an illustrative embodiment.

With reference to FIG. 4, a block diagram of controller 106 is shown in accordance with an illustrative embodiment. Controller 106 may include a second output interface 400, a second input interface 402, a second computer-readable medium 404, a second communication interface 406, a second processor 408, and a key identification application 410. Different and additional or fewer components may be incorporated into controller 106. Controller 106 may include one or more computing devices of various types. The one or more computing devices may include computers of any form factor such as a personal digital assistant, a desktop, a laptop, an integrated messaging device, a smart phone, a tablet computer, etc.

Second output interface 400 provides an interface for outputting information for review or analysis by a user of controller 106. Controller 106 may have one or more output interfaces that use the same or a different interface technology. For example, second output interface 400 may include an interface to a display 412, a speaker, a printer, a database, etc. Display 412 may be a thin film transistor display, a light emitting diode display, a liquid crystal display, or any of a variety of different displays known to those skilled in the art. Display 412, the speaker, the printer, and/or the database further may be accessible to controller 106 through second communication interface 406. The same interface may support both second output interface 400 and second input interface 402. For example, display 412 comprising a touch screen both allows the input and the output of information to controller 106.

Second input interface 402 provides the same or similar functionality as that described with reference to input interface 202 of first automatic player piano 102. The same interface may support both second output interface 400 and second input interface 402. For example, display 412 comprising a touch screen both allows the input and the output of information to controller 106. Second computer-readable medium 404 provides the same or similar functionality as that described with reference to computer-readable medium 204 of first automatic player piano 102. Second communication interface 406 provides the same or similar functionality as that described with reference to communication interface 206 of first automatic player piano 102. Second communication interface 406 may support the transmission/reception of signals to/from double keyboard console 108, first automatic player piano 102, and/or second automatic player piano 104. Second processor 408 provides the same or similar functionality as that described with reference to processor 208 of first automatic player piano 102.

Key identification application 410 performs operations associated with processing the signals received from double keyboard console 108 and identifying the one or more keys of the first plurality of controlled keys 112 and/or the second plurality of controlled keys 114 and the plurality of controlled pedals 212 of first automatic player piano 102 and/or second automatic player piano 104 to be played. The operations may be implemented using hardware, firmware, software, or any combination of these methods. With reference to the example embodiment of FIG. 4, key identification application 410 is implemented in software (comprised of computer-readable and/or computer-executable instructions) stored in second computer-readable medium 404 and accessible by second processor 408 for execution of the instructions that embody the operations of key identification application 410. Key identification application 410 may be written using one or more programming languages, assembly languages, scripting languages, etc.

Figure 5:
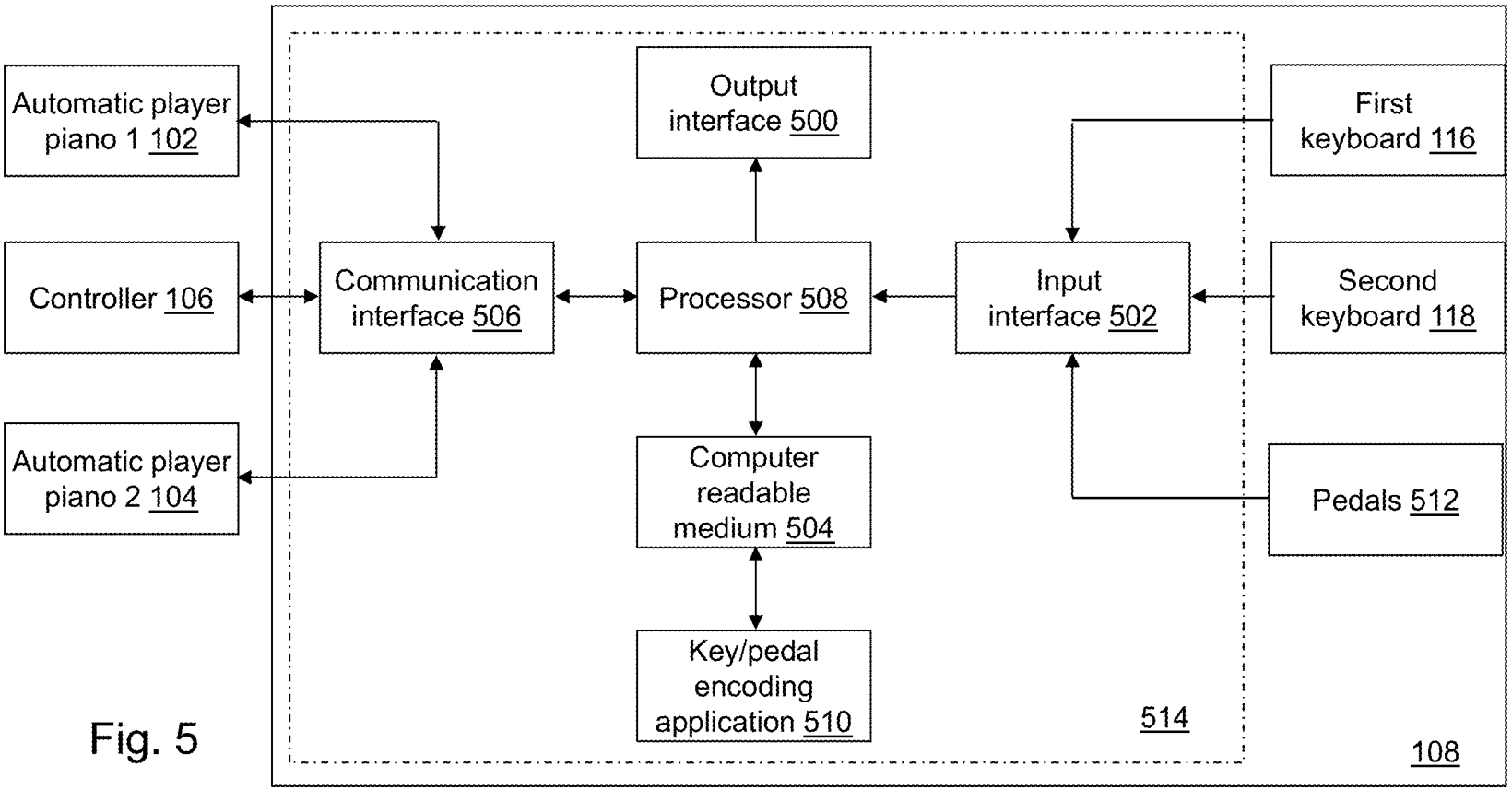
FIG. 5 depicts a block diagram of a double keyboard console of the double keyboard piano system of FIG. 1 in accordance with an illustrative embodiment.

With reference to FIG. 5, a block diagram of electronic components of double keyboard console 108 is shown in accordance with an illustrative embodiment. Double keyboard console 108 may include electronic components 514, first keyboard 116, second keyboard 118, and a plurality of pedals 512. Electronic components 514 may include a third output interface 500, a third input interface 502, a third computer-readable medium 504, a third communication interface 506, a third processor 508, and a key/pedal encoding application 510. Different and additional or fewer components may be incorporated into double keyboard console 108 and/or electronic components 514.

Third output interface 500 provides the same or similar functionality as that described with reference to second output interface 400 of controller 106. Third computer-readable medium 504 provides the same or similar functionality as that described with reference to computer-readable medium 204 of first automatic player piano 102. Third communication interface 506 provides the same or similar functionality as that described with reference to communication interface 206 of first automatic player piano 102. Third communication interface 506 may support the transmission/reception of signals to/from controller 106, first automatic player piano 102, and/or second automatic player piano 104. Third processor 508 provides the same or similar functionality as that described with reference to processor 208 of first automatic player piano 102.

Third input interface 502 provides an interface for creating signals indicating operation of the one or more keys of first keyboard 116, of the one or more keys of second keyboard 118, and of one or more of the plurality of pedals 512. Third input interface 502 further may provide the same or similar functionality as that described with reference to input interface 202 of first automatic player piano 102. Double keyboard console 108 may have one or more input interfaces that use the same or a different interface technology. In an illustrative embodiment, third input interface 502 includes sensors positioned to determine whether or not the one or more keys of first keyboard 116, the one or more keys of second keyboard 118, and/or the one or more of the plurality of pedals 512 has been depressed.

Key/pedal encoding application 510 performs operations associated with processing the signals received through input interface 502 into a form for output through communication interface 506. The operations may be implemented using hardware, firmware, software, or any combination of these methods. With reference to the example embodiment of FIG. 5, key/pedal encoding application 510 is implemented in software (comprised of computer-readable and/or computer-executable instructions) stored in third computer-readable medium 504 and accessible by third processor 508 for execution of the instructions that embody the operations of key/pedal encoding application 510. Key/pedal encoding application 510 may be written using one or more programming languages, assembly languages, scripting languages, etc.

Figure 6A:
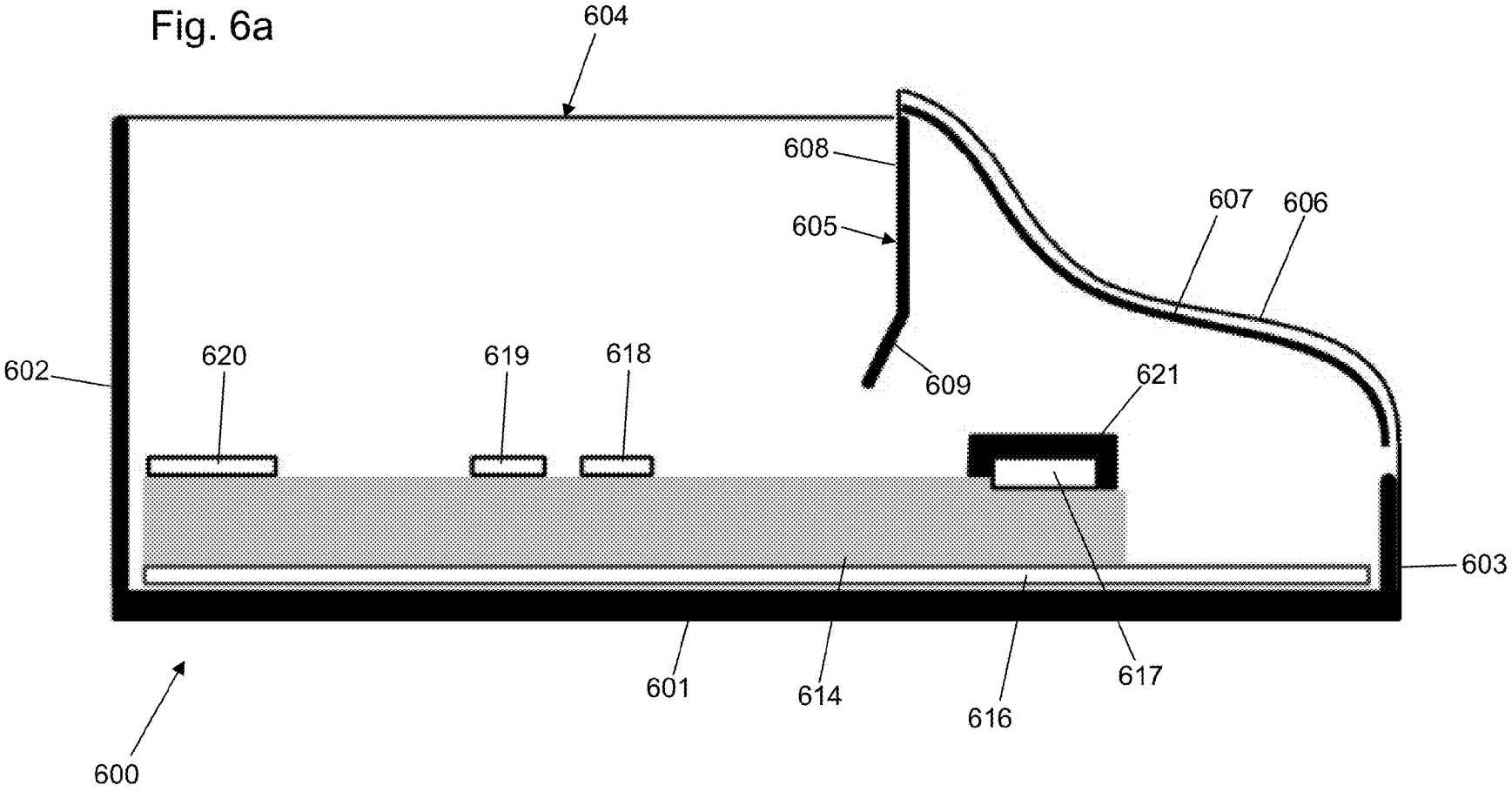
FIGS. 6*a*-6*c* depict side and top views of the double keyboard console of FIG. 5 in accordance with an illustrative embodiment.
Figure 6B:
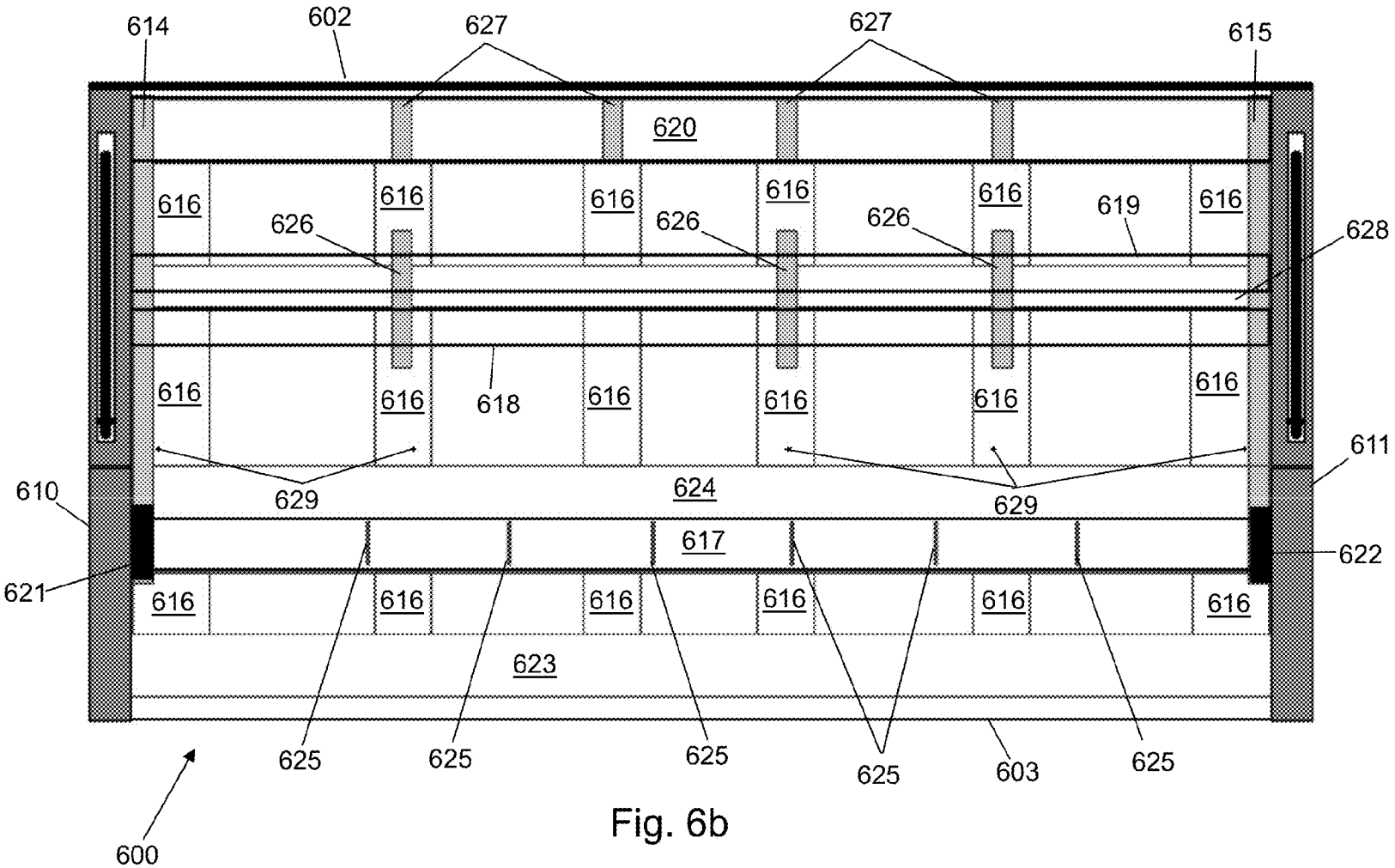
Figure 6C:
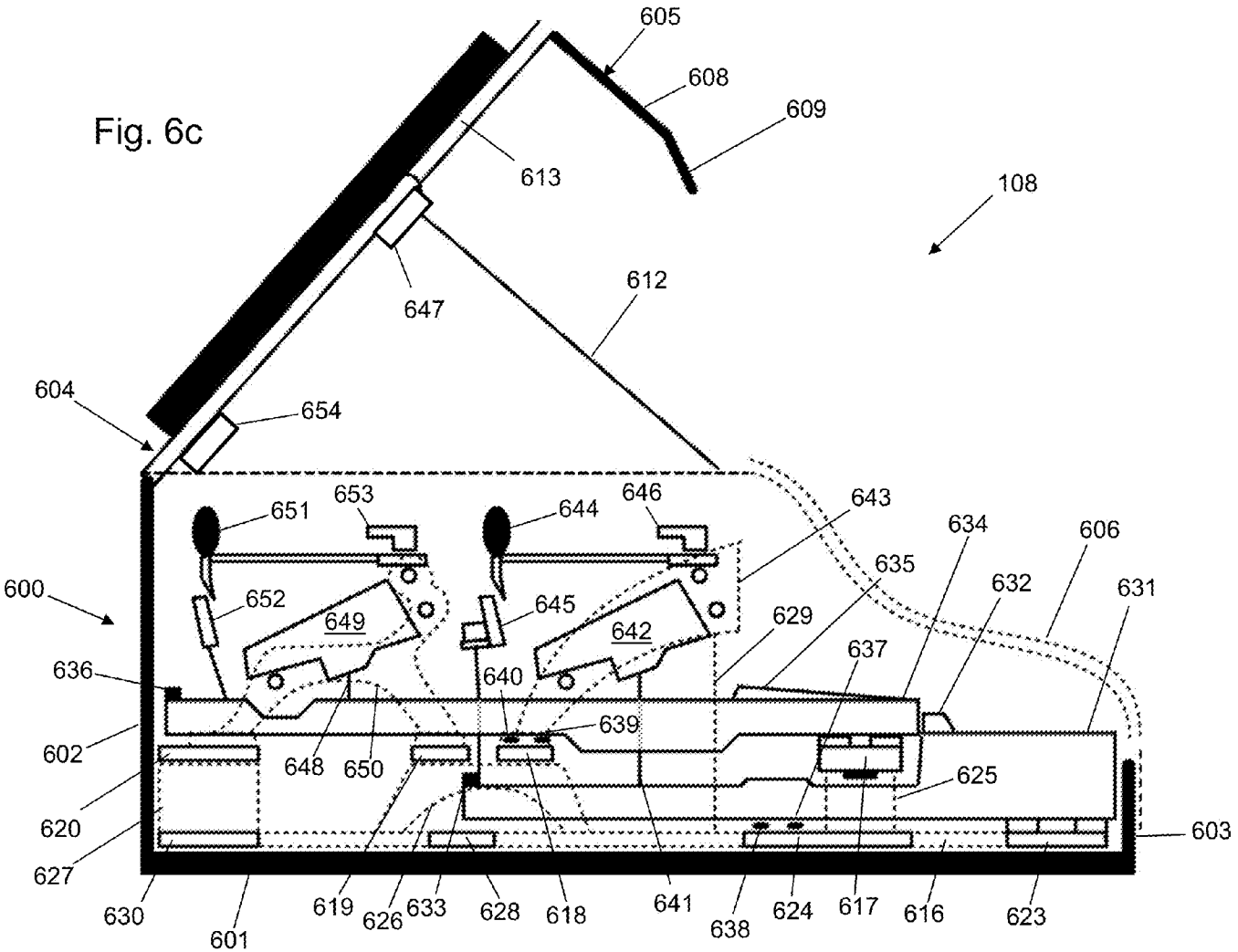

With reference to FIG. 6*a*, a side view of double keyboard console 108 is shown in accordance with an illustrative embodiment without first keyboard 116 and second keyboard 118 and their associated action mechanisms. With reference to FIG. 6*b*, a top, open view of double keyboard console 108 is shown in accordance with an illustrative embodiment without the one or more keys of first keyboard 116 and the one or more keys of second keyboard 118, and their associated action mechanisms to illustrate the support structures. With reference to FIG. 6*c*, a side view of double keyboard console 108 is shown in accordance with an illustrative embodiment with a single key of first keyboard 116 and a single key of second keyboard 118 and their associated action mechanisms.

Double keyboard console 108 may include a housing 600. Housing 600 may be formed of one or more materials including wood, hard plastic, metal, etc. Housing 600 may include a key bed 601, a back wall 602, a key slip 603, a lid 604, a fallboard 605, a rim 606, a key cover 607, a first fallboard section 608, a second fallboard section 609, a left side wall 610, a right side wall 611, a hook 612, and a key cover compartment 613. Key bed 601, back wall 602, key slip 603, lid 604, key cover 607, left side wall 610, and right side wall 611 form an enclosure that supports and protects first keyboard 116, second keyboard 118, and their associated action mechanisms.

Key bed 601 provides a base for double keyboard console 108 and supports the internal components including first keyboard 116 and second keyboard 118 and their associated action mechanisms. Back wall 602 and key slip 603 extend up from opposite ends of key bed 601. Key slip 603 is positioned between the pianist and the keys. Key slip 603 may be configured to be removed if removal of first keyboard 116 and/or of second keyboard 118 and their associated action mechanisms is desired. Left side wall 610 and right side wall 611 extend up from opposite ends of key bed 601 in a direction generally perpendicular to back wall 602 and key slip 603. Rim 606 forms part of a top surface of left side wall 610 and right side wall 611 that extends up from first keyboard 116 and second keyboard 118. Housing 600 is supported by a plurality of legs not shown.

In the illustrative embodiment of FIG. 6*a*, lid 604 is shown in a closed position. In the illustrative embodiment of FIG. 6*c*, lid 604 is shown in an open position. When double keyboard console 108 is played, lid 604 is in the closed position. Lid 604 may include fallboard 605, a key cover compartment 613, a first hammer strike board 647, and a second hammer strike board 654. In an illustrative embodiment, lid 604 may be open for construction and maintenance.

Fallboard 605 extends down from a first end of lid 604. In the closed position, fallboard 605 is mounted to a plurality of first action brackets 643. Fallboard 605 may include first fallboard section 608 and second fallboard section 609. First fallboard section 608 mounts to and extends from lid 604. Second fallboard section 609 mounts to and extends inward from first fallboard section 608 providing additional room for the one or more keys of second keyboard 118 while also positioning first main action mechanism 642 close to the pianist. Second fallboard section 609 may also serve as a key-stop rail for the one or more keys of second keyboard 118. When used as a key-stop rail, second fallboard section 609 may be capped with felt. Additionally, fallboard 605 may be mounted to the plurality of first action brackets 643 to allow adjustment of the downward pressure of second fallboard section 609 on the one or more keys of second keyboard 118. For example, fallboard 605 may mount to the plurality of first action brackets 643 using screws positioned at a downward angle.

In an illustrative embodiment, key cover 607 is used to cover first keyboard 116 and second keyboard 118. In an illustrative embodiment, key cover 607 is an articulated screen. When finished playing, the pianist can pull key cover 607 out of key cover compartment 613 along slots in rim 606 towards key slip 603. The slots in rim 606 may be positioned on each side of first keyboard 116 and second keyboard 118.

Because double keyboard console 108 does not directly produce sound, there are no strings. In the absence of strings, first hammer strike board 647 and second hammer strike board 654 are mounted on an underside of lid 604. In an illustrative embodiment, first hammer strike board 647 and second hammer strike board 654 are ribs aligned with a first hammer 644 and a second hammer 651 when lid 604 is in the closed position. First hammer strike board 647 and second hammer strike board 654 may be covered in felt or other suitable material to absorb noise from the hammer strikes.

Hook 612 may be used to support lid 604 in the open position. In an illustrative embodiment, double keyboard console 108 includes two hooks, one on each side of double keyboard console 108. When not in use hook 612 may be housed in cavities carved into rim 606 on each side of double keyboard console 108. The cavities may be shaped so that hook 612 remains tucked beneath a top edge of rim 606.

Double keyboard console 108 further may include a plurality of support structures for supporting the one or more keys of first keyboard 116, the one or more keys of second keyboard 118, and the action mechanisms associated with each. The plurality of support structures may be formed of one or more materials including wood, hard plastic, metal, etc. The plurality of support structures are mounted within housing 600. Thus, housing 600 is sized and shaped to accommodate the support structures and first keyboard 116, second keyboard 118, and the action mechanisms associated with each. In the illustrative embodiment, double keyboard console 108 may include a first upper keyboard side support 614, a second upper keyboard side support 615, a plurality of key frame struts 616, a second front rail 617, a second balance rail 618, an upper action bracket support rail 619, a second back rail 620, a first upper front rail side bracket 621, a second upper front rail side bracket 622, a first front rail 623, a first balance rail 624, a first plurality of upper rail brackets 625, a second plurality of upper rail brackets 626, a third plurality of upper rail brackets 627, a first back rail 628, a plurality of lower action bracket balance posts 629, and a back support rail 630. A fewer or a greater number of support structures may be used based on the type of piano and the selected action mechanisms.

First upper keyboard side support 614 is mounted to left side wall 610 and to a leftmost of the plurality of key frame struts 616 to support second front rail 617, second balance rail 618, upper action bracket support rail 619, and second back rail 620, and thus, second keyboard 118 and its associated action mechanisms. Second upper keyboard side support 615 is mounted to right side wall 611 and to a rightmost of the plurality of key frame struts 616 and also supports second front rail 617, second balance rail 618, upper action bracket support rail 619, and second back rail 620, and thus, second keyboard 118 and its associated action mechanisms.

In an illustrative embodiment, the plurality of key frame struts 616 include six key frame struts, one at each end of first keyboard 116, one at each break between keyboard registers, and one in a middle of a tenor section of first keyboard 116 as shown with reference to FIG. 6*b*.

The plurality of first action brackets 643 includes five brackets, two at each end and three at the register breaks. The plurality of first action brackets 650 also includes five brackets, two at each end and three at the register breaks. In the illustrative embodiment, the plurality of first action brackets 650 are shaped similarly to those included in a Steinway B Grand Piano manufactured by Steinway & Sons. Each bracket of the plurality of first action brackets 643 has a generally 90 degree arched shape that curves downward towards back wall 602, and allows three action rails to be attached in the same relative positions as occur with the plurality of second action brackets 650.

First front rail 623 may be positioned under a first end of each of the one or more keys of first keyboard 116 and extends generally parallel to key slip 603. Second front rail 617 may be positioned under the first end of each of the one or more keys of second keyboard 118 and extends generally parallel to key slip 603. As understood by a person of skill in the art, first front rail 623 and second front rail 617 may be capped with pins and felt disks to absorb the blow, for example, when a first key 634 or a second key 634, respectively, is depressed. Second front rail 617 may also be positioned as the key stop for the one or more keys of first keyboard 116. In the illustrative embodiment, second front rail 617 may be thickened to approximately 0.75 inches and covered underneath with felt or other suitable material.

First balance rail 624 may be positioned under a first balance pin 637 of each white key of the one or more keys of first keyboard 116 and under a second balance pin 638 of each black key of the one or more keys of first keyboard 116. Second balance rail 618 may be positioned under a third balance pin 639 of each white key of the one or more keys of second keyboard 118 and a fourth balance pin 640 of each black key of the one or more keys of second keyboard 118. First balance rail 624 may be longer than second balance rail 618 because first balance rail 624 may also support second front rail 617.

A plurality of brackets may be used to support second front rail 617 above the one or more keys of first keyboard 116 without sagging. Second front rail 617 may be supported at each end by first upper front rail side bracket 621 and second upper front rail side bracket 622. In an illustrative embodiment, first upper front rail side bracket 621 and second upper front rail side bracket 622 may be generally inverted "U" shaped brackets that are mounted over second front rail 617 at each end of second keyboard 118. The plurality of brackets further may include the first plurality of upper rail brackets 625. In an illustrative embodiment, the plurality of brackets has an "I" shape. A vertical portion of the "I" shape of the first plurality of upper rail brackets 625 may be slipped between the lower keys C and C# in each octave except for the first.

Shavings may be taken off of the edges of the adjacent keys to avoid friction. A lower tab of each of the first plurality of upper rail brackets 625 is mounted to first balance rail 624. An upper tab of each of the brackets is mounted to second front rail 617.

Upper action bracket support rail 619 supports a front foot of each of a plurality of second action brackets 650 that support a second main action mechanism 649 for each key of the one or more keys of second keyboard 118. Upper action bracket support rail 619 is supported by the second plurality of upper rail brackets 626 at the register breaks and by first upper keyboard side support 614 and by second upper keyboard side support 615.

First back rail 628 supports the one or more keys of first keyboard 116 at the back end and may be capped with felt. Second back rail 620 supports the one or more keys of second keyboard 118 at the back end and may be capped with felt. Second back rail 620 also supports a back foot of the plurality of second action brackets 650 that support second main action mechanism 649 at the register breaks. Second back rail 620 is supported by first upper keyboard side support 614 and by second upper keyboard side support 615 at each end and in between by the third plurality of upper rail brackets 627.

In the illustrative embodiment, the second plurality of upper rail brackets 626 includes three arches positioned one at each register break. In an illustrative embodiment, the second plurality of upper rail brackets 626 are made of metal though this is not required. A top of each of the second plurality of upper rail brackets 626 has a flat surface to which both upper action bracket support rail 619 and second balance rail 618 are mounted. A foot at the end of each side of the arch of each of the second plurality of upper rail brackets 626 is mounted to a strut of three of the plurality of key frame struts 616.

Back support rail 630 provides support under second back rail 620, extends generally parallel to and adjacent back wall 602, and is mounted to key bed 601. In the illustrative embodiment, the third plurality of upper rail brackets 627 includes four brackets. The third plurality of upper rail brackets 627 are positioned along the four center axes defined by the plurality of key frame struts 616 to support second back rail 620 above back support rail 630.

In the illustrative embodiment, the plurality of lower action bracket balance posts 629 include five posts to provide additional support for the plurality of first action brackets 643 to which fallboard 605 is mounted. The plurality of lower action bracket balance posts 629 may comprise narrow posts that mount to a front of the plurality of first action brackets 643, extend through holes drilled through particular keys of both first keyboard 116 and second keyboard 118, and rest on five of the six key frame struts 616. A threaded approximately 0.75 inch ell at a top of each of the plurality of lower action bracket balance posts 629 allows insertion through an appropriate hole in the plurality of first action brackets 643 to fine tune its left-to-right position relative to first keyboard 116 and second keyboard 118 and to secure it with two nuts.

A first key 631 of first keyboard 116 is shown positioned relative to a second key 634 of second keyboard 118. Second key 634 is positioned generally above first key 631. In the illustrative embodiment of FIG. 6*c*, both first key 631 and second key 634 are shown in the depressed state. First key 631 and second key 634 are provided as illustration of the arrangement of the additional one or more keys of first keyboard 116 and second keyboard 118, which is further illustrated in FIGS. 8*a*-8*b*. First key 631 may have various lengths though in an illustrative embodiment, first key 631 is approximately 19 inches long as measured from key slip 603. Second key 634 may have various lengths though in an illustrative embodiment, second key 634 is approximately 22 inches long.

A step 632 may be positioned on first key 631 of first keyboard 116 adjacent a first end of second key 634 of second keyboard 118 to facilitate playing on first keyboard 116 and second keyboard 118 simultaneously with a single hand. Step 632 positions each white key at the same level as the adjacent black keys. In an illustrative embodiment, step 632 has a height of approximately 0.5 inches and a length of approximately 0.75 inches. The black keys of first keyboard 116 may be notched in an area adjacent step 632.

A wedge 635 may be positioned on second key 634 of second keyboard 118 to angle the one or more keys of second keyboard 118 upward also to facilitate playing on first keyboard 116 and second keyboard 118 simultaneously with a single hand. In an illustrative embodiment, wedge 635 is mounted at a front, visible end of second key 634 and has a total length of approximately 5.5 inches. Each black key of second keyboard 118 may be elevated so that its upper surface is parallel to the upper surface of the adjacent white notes. The distance from the front of the white keys to the front of the black keys may be shorter for second keyboard 118 than for first keyboard 116.

Though dampers are superfluous in double keyboard console 108, a metal weight may be placed at the back of each of the one or more keys of first keyboard 116 and of the one or more keys of second keyboard 118. For example, a first weight 633 is positioned on a back end of first key 631, and a second weight 636 is positioned on a back end of second key 634. The size of each of first weight 633 and of second weight 636 is selected to fit within the space requirements and the mass is selected to match a real damper and to achieve the proper key balance and touch.

Each key of the one or more keys of first keyboard 116 is mounted to an action mechanism such as action mechanism 302 shown with reference to FIG. 3. Similarly, each key of the one or more keys of second keyboard 118 is mounted to an action mechanism such as action mechanism 302 shown with reference to FIG. 3. The action mechanisms may be simpler than those employed in pianos that strike strings though it may be desirable that the action mechanisms included in double keyboard console 108 recreate as exactly as possible the touch and feel of ordinary piano playing. It may also be desirable to employ readily-available action mechanism parts pre-built by manufacturers such as Yamaha Corporation or Steinway & Sons.

For illustration, FIG. 6*c* shows a first main action mechanism 642 mounted to first key 631 through a first capstan 641, and a second main action mechanism 649 mounted to second key 634 through a second capstan 648. The action mechanism for first key 631 may further include a first hammer 644, a first back check 645, and a first sensor 646. The action mechanism for second key 634 may further include a second hammer 651, a second back check 652, and a second sensor 653.

In an illustrative embodiment, second capstan 648 has a slightly longer than usual length of approximately 0.75 inches, while first capstan 641 has a length of approximately 3.25 inches and a diameter selected to pass through the one or more keys of second keyboard 118, i.e. approximately ⅛ inch diameter at least at the section through the one or more keys of second keyboard 118. As usual, the top ¼" of first capstan 641 and second capstan 648 includes a button for supporting a wippen, and has a hole that permits screwing in and out for adjustment. The button of first capstan 641 may be a separate, detachable piece that mates with a threaded tip of the narrow midsection. A lower portion of first capstan 641 may have a wider diameter to increase its strength and be threaded for driving into first key 631.

First hammer 644 and second hammer 651 may include standard felt hammer-heads though other suitable substitutes may be used with weights chosen to simulate the feel of a normal piano action through its various registers.

Second back check 652 is similar to that in a piano such as the Steinway B Grand Piano manufactured by Steinway & Sons except that the wire may be slightly longer. For example, a vertical elevation of a top of second back check 652 above second key 634 in a depressed position may be approximately 3 inches, as opposed to the usual 2.5 inches. First back check 645 projects upwards through second key 634. As a result, a top of first back check 645 is positioned approximately 5.5 inches above first key 631 when first key 631 is in a depressed position. The position of various supporting structures may also dictate that first back check 645 attach to first key 631 approximately 0.5 inches from its back end, considerably closer than usual. Because of this, the normal method of adjusting back checks by bending the wire may not work well for first back check 645. Instead, first back check 645 can be mounted by tightening or loosening a first screw mounted in a direction generally parallel to the wire of first back check 645 and/or a second screw mounted in a direction generally perpendicular to the first screw, adding punchings as necessary. The first screw and the second screw allow the position of first back check 645 to be fine tuned along both the up-and-down and back-and-forward axes. A vertical shaft of the wire of first back check 645 that passes through second key 634 may have a threaded top tip so that the top of first back check 645 can be screwed off or otherwise removed from the wire. The bottom tip of the vertical shaft may also be threaded to provide the option for removing it.

First sensor 646 detects the initial movement of first hammer 644 and sends the information to processor 508 which controls transmission of the information through communication interface 506 to controller 106 and/or first automatic player piano 102. Second sensor 653 detects the initial movement of second hammer 651 and sends the information to processor 508 which controls transmission of the information through communication interface 506 to controller 106 and/or second automatic player piano 104. First sensor 646 and second sensor 653 may be digital sensors that can detect the respective hammer's motion the instant it begins to rise and relay the information without delay. In an illustrative embodiment, first sensor 646 and second sensor 653 may be Disklavier™ Mark 4 Pro sensors manufactured by Yamaha Corporation. Processor 508 may determine a key number of each depressed/released key and may calculate a key velocity based on signals from first sensor 646 and/or second sensor 653.

Figure 7A:
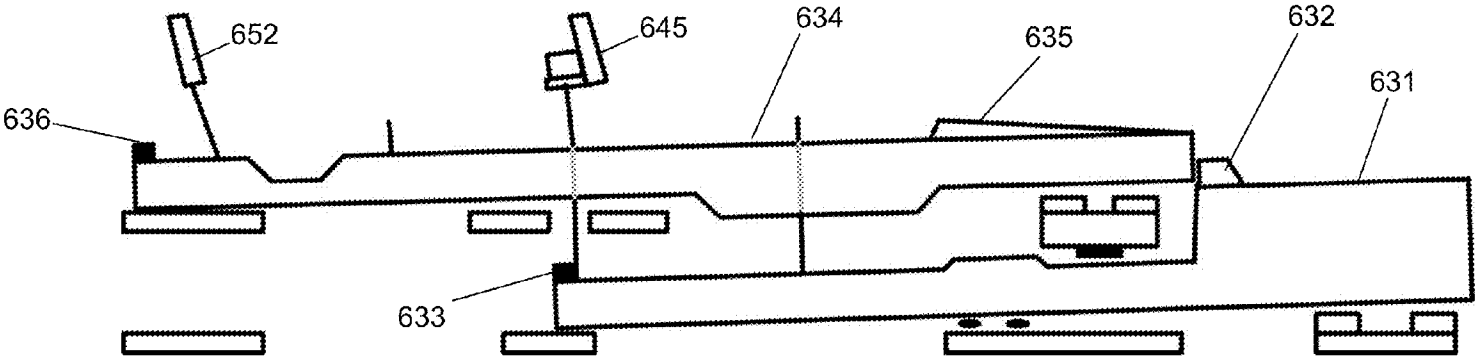
FIGS. 7*a*-7*d* depict side views of two stacked keys of the double keyboard console of FIG. 5 in various states of being depressed (played) and not being depressed (not being played) in accordance with an illustrative embodiment.
Figure 7B:
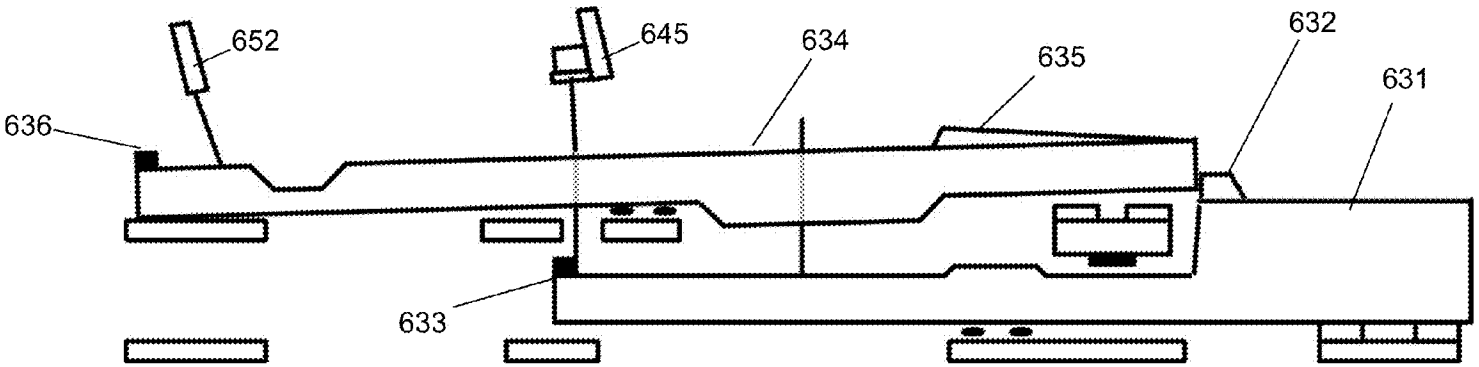
Figure 7C:
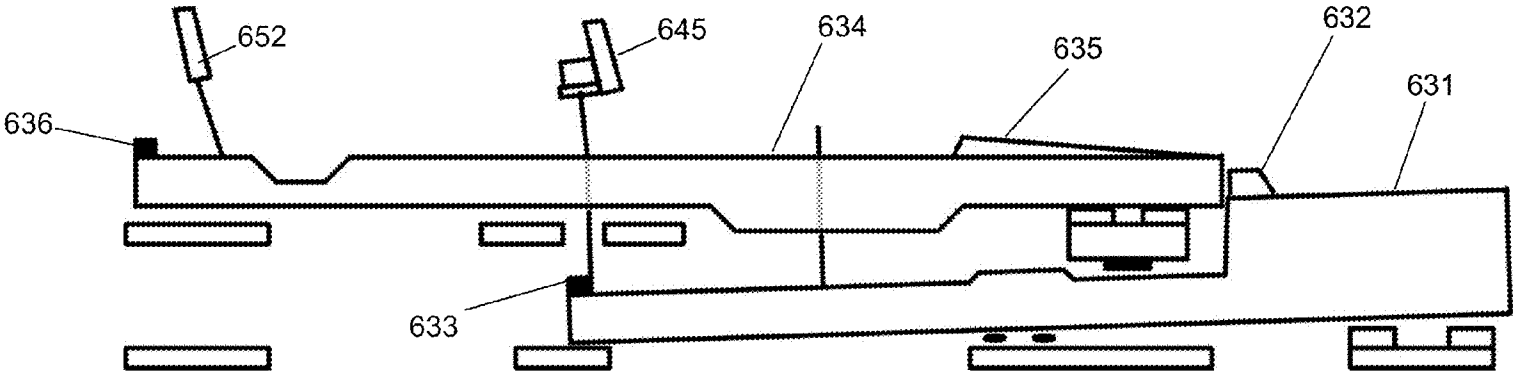
Figure 7D:
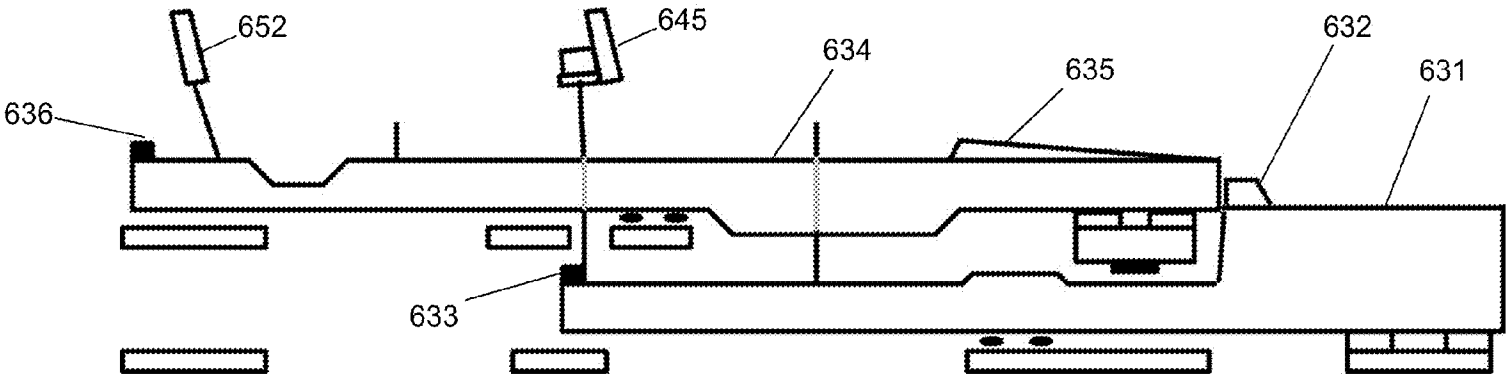

With reference to FIG. 7*a*, first key 631 and second key 634 are both shown in a released position. With reference to FIG. 7*b*, second key 634 is shown in a released position, and first key 631 is shown in a depressed position. With reference to FIG. 7*c*, first key 631 is shown in a released position, and second key 634 is shown in a depressed position. With reference to FIG. 7*d*, first key 631 and second key 634 are both shown in a depressed position.

Figure 8A:
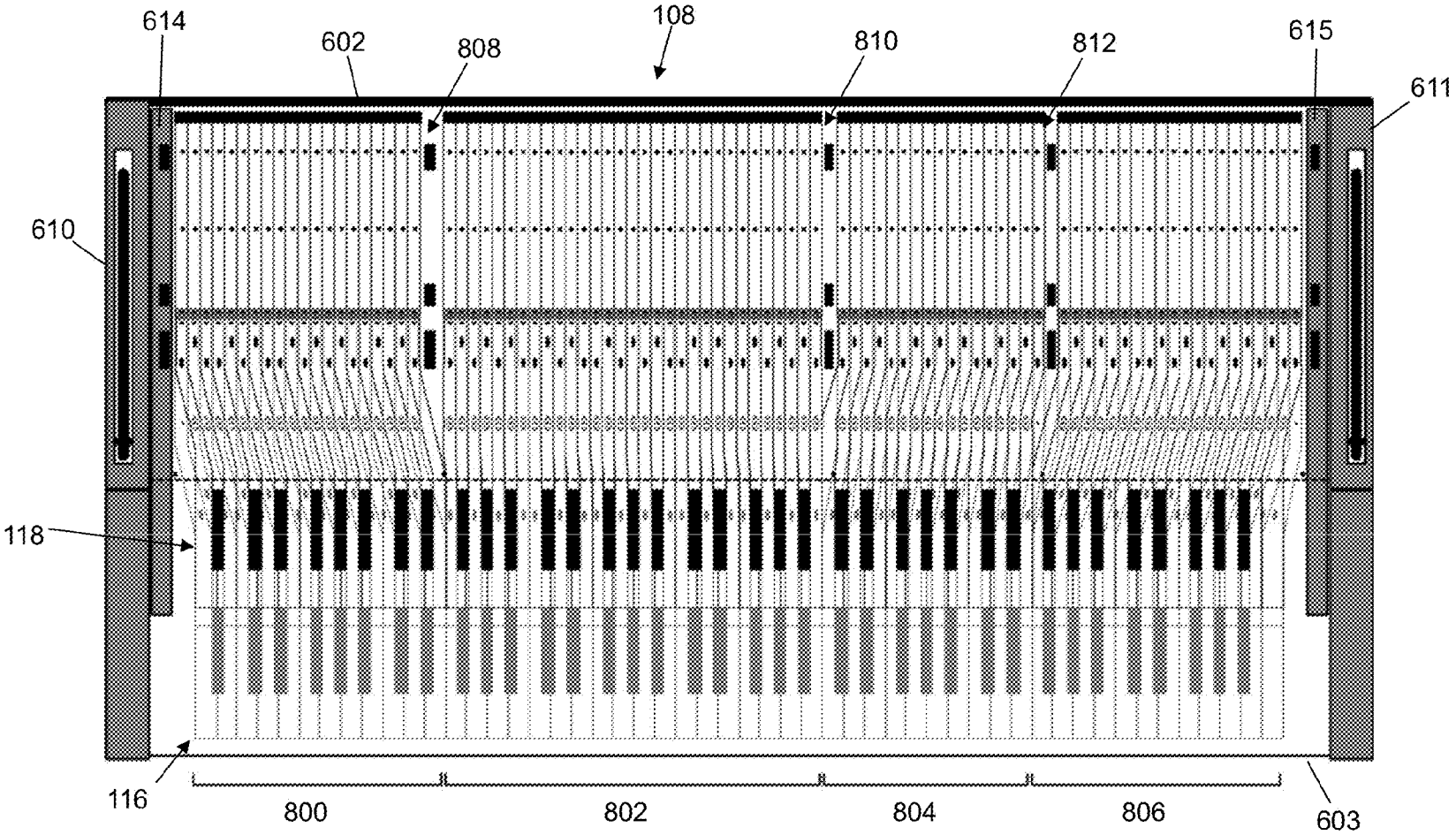
FIGS. 8*a*-8*c* depict top views of the double keyboard console of FIG. 5 without a lid to show the key layouts in accordance with an illustrative embodiment.
Figure 8B:
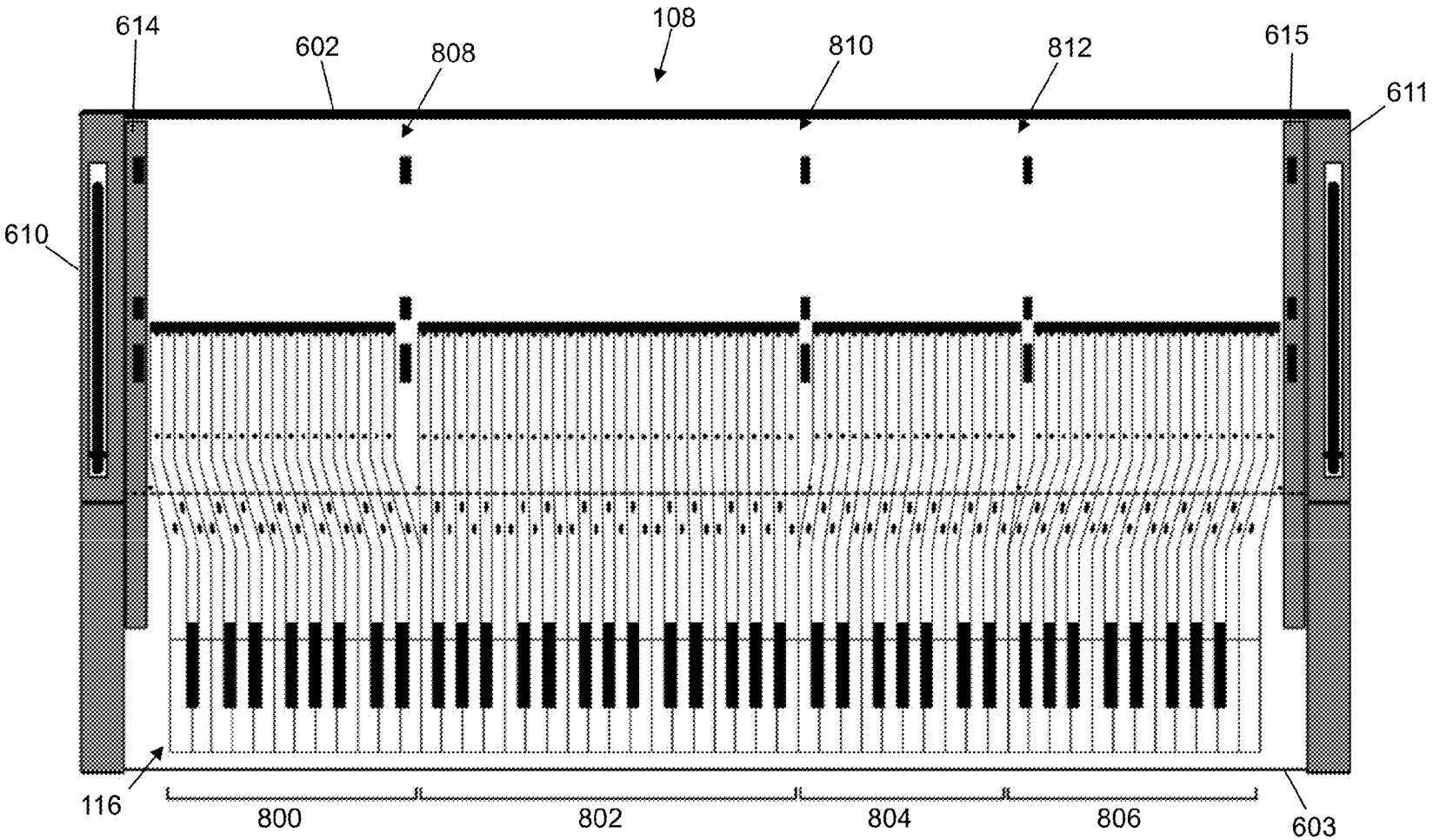
Figure 8C:
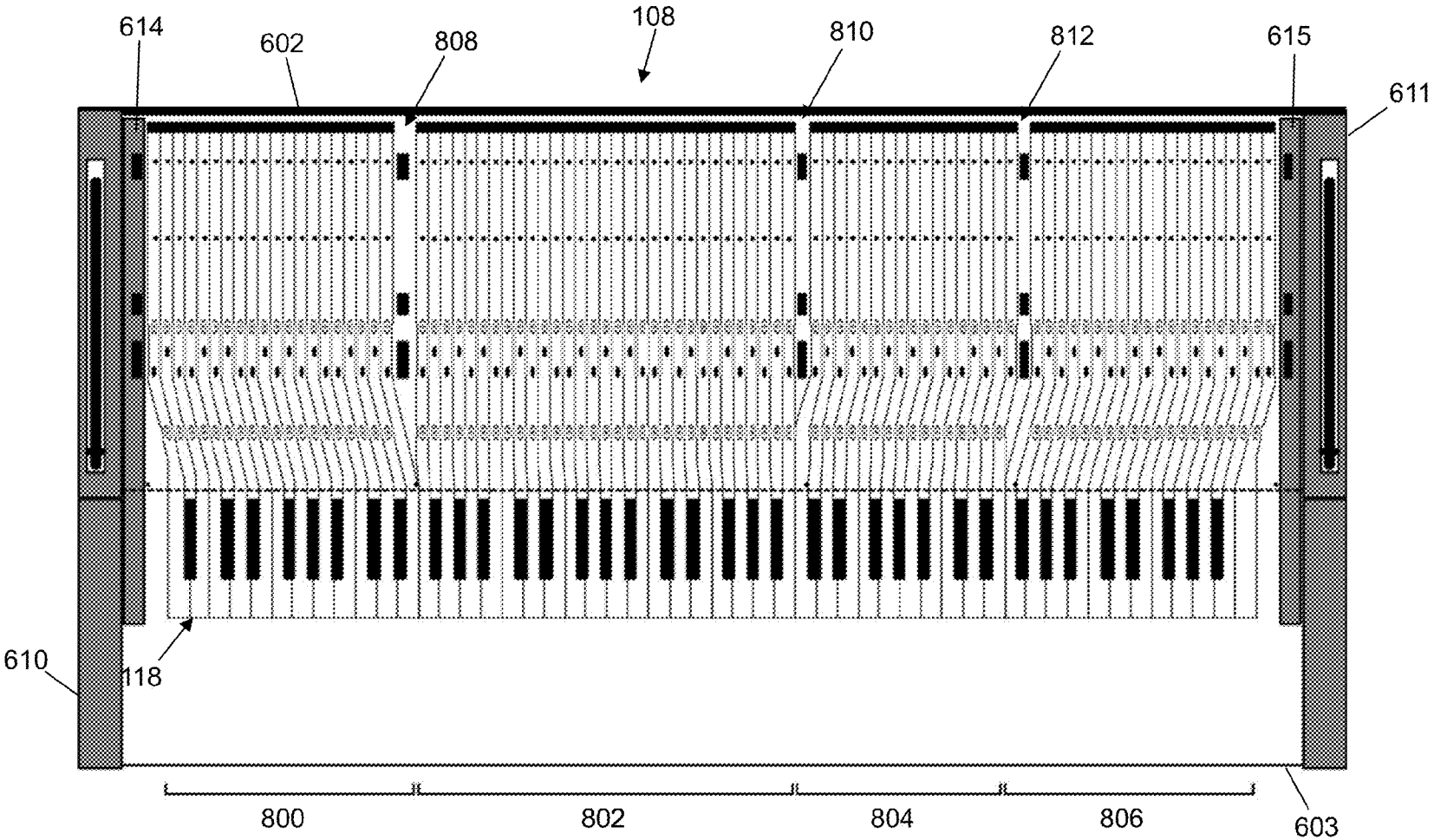

With reference to FIG. 8*a*, first keyboard 116 and second keyboard 118 are shown in accordance with an illustrative embodiment. In the illustrative embodiment, first keyboard 116 and second keyboard 118 have the same arrangement of keys. With reference to FIG. 8*b*, first keyboard 116 is shown without second keyboard 118 for clarity. With reference to FIG. 8*c*, second keyboard 118 is shown without first keyboard 116 for clarity. First keyboard 116 and second keyboard 118 are arranged into four groups of keys as understood by a person of skill in the art. A first key group 800 may include the bass keys. A second key group 802 may include the tenor keys. A third key group 804 may include the treble keys. A fourth key group 806 may include the top keys. A first register break 808 is positioned between first key group 800 and second key group 802. A second register break 810 is positioned between second key group 802 and third key group 804. A third register break 812 is positioned between third key group 804 and fourth key group 806. As a result, the keys of second key group 802 are generally straight, the keys of first key group 800 curve outward toward left side wall 610, and the keys of third key group 804 and fourth key group 806 curve outward toward right side wall 611 to avoid the register breaks.

Figure 9C:
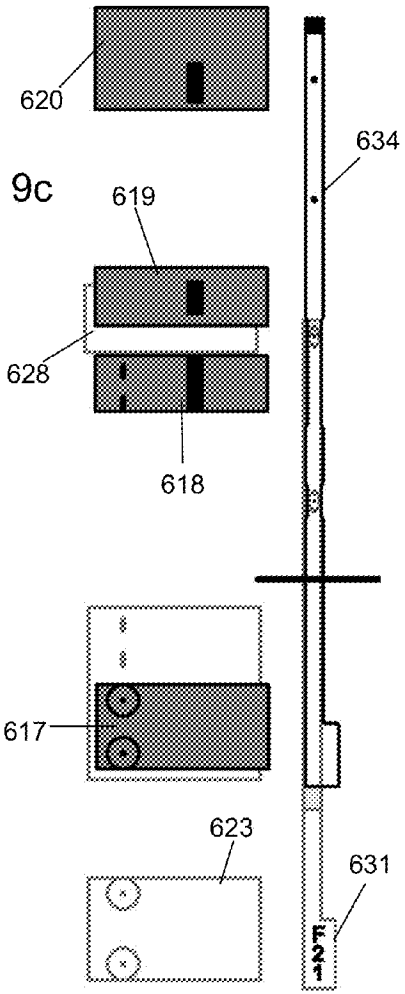
FIGS. 9*a*-9*c* depict top views of the two stacked keys of FIGS. 7*a*-7*d* in accordance with an illustrative embodiment.
Figure 9B:
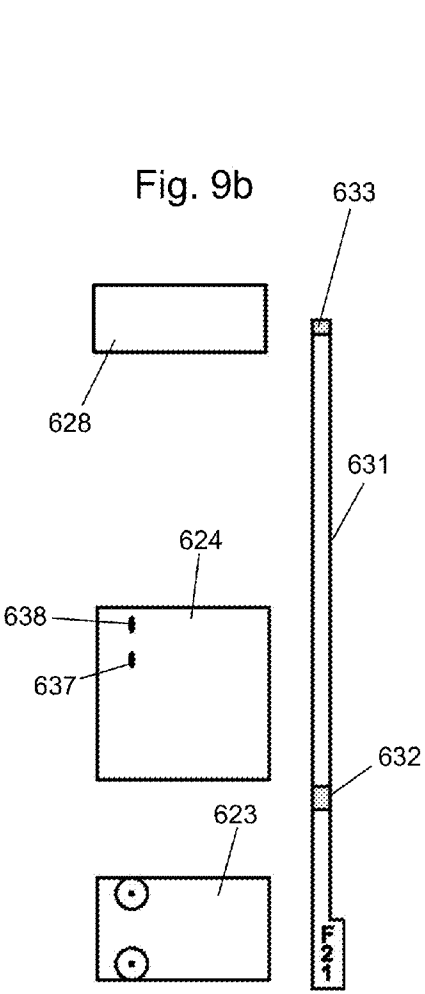
Figure 9A:
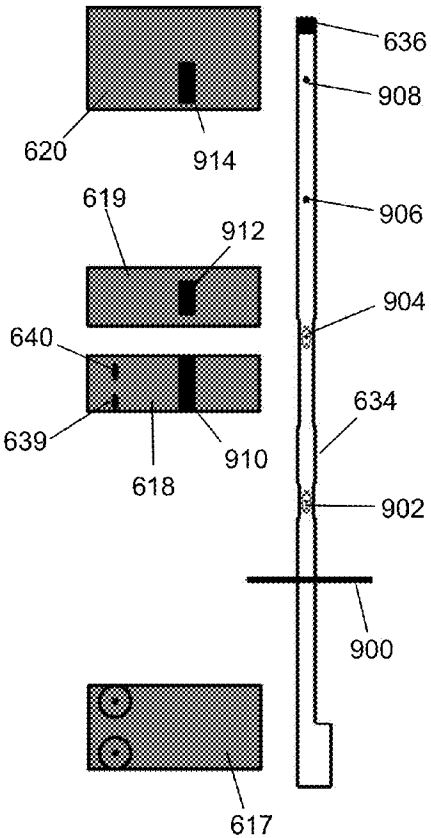

With reference to FIG. 9*a*, a top view of second key 634 is shown in accordance with an illustrative embodiment. With reference to FIG. 9*b*, a top view of first key 631 is shown in accordance with an illustrative embodiment. With reference to FIG. 9*c*, a top view of second key 634 overlaid on first key 631 is shown in accordance with an illustrative embodiment. For reference a fallboard contact point 900 is shown overlaid on second key 634. Second key 634 includes a first opening 902 through which first capstan 641 extends, a second opening 904 through which a first wire support of first back check 645 extends, a first anchor point 906 indicates a point at which second capstan 648 is mounted to second key 634, and a second anchor point 908 indicates a point at which back check 652 is mounted to second key 634.

A first footprint 910 indicates a location of a foot of a first action bracket of the plurality of first action brackets 643. A second footprint 912 indicates a location of a front foot of a second action bracket of the plurality of second action brackets 650. A third footprint 914 indicates a location of a back foot of the second action bracket of the plurality of second action brackets 650.

Figure 10C:
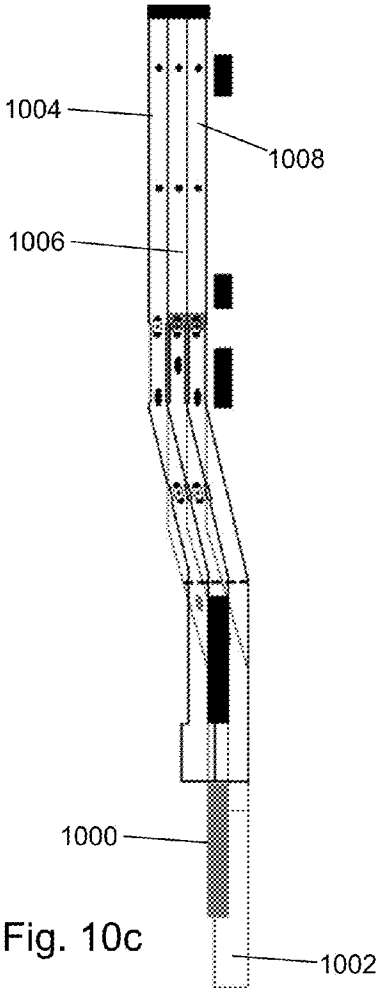
FIGS. 10*a*-10*c* depict top views of curved, stacked keys of the double keyboard console of FIG. 5 in accordance with an illustrative embodiment.
Figure 10B:
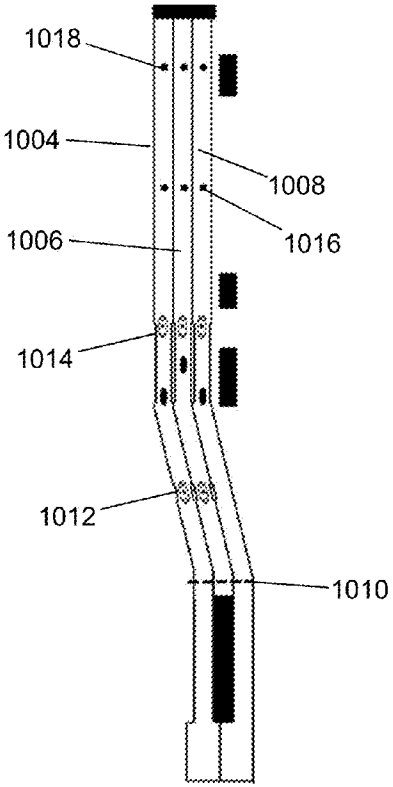
Figure 10A:
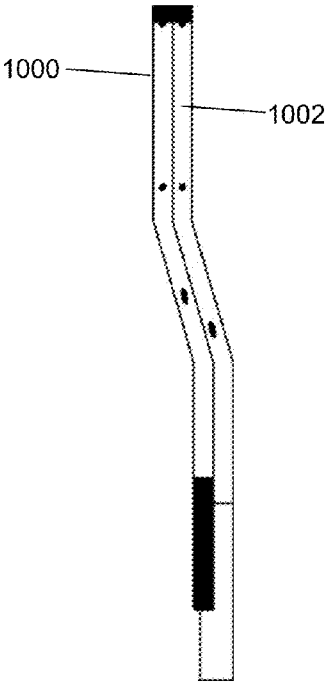

With reference to FIG. 10*a*, a top view of a first black key 1000 and a first white key 1002 of first keyboard 116 is shown in accordance with an illustrative embodiment. With reference to FIG. 10*b*, a top view of a second white key 1004, a second black key 1006, and a third white key 1008 of second keyboard 118 is shown in accordance with an illustrative embodiment. With reference to FIG. 10*c*, a top view of second white key 1004, second black key 1006, and third white key 1008 overlaid on first black key 1000 and first white key 1002 is shown in accordance with an illustrative embodiment. Second white key 1004, second black key 1006, third white key 1008, first black key 1000, and first white key 1002 are keys in first group 800 adjacent first register break 808 and are thus curved outward toward the left. The keys of third group 804 and fourth group 806 are similarly curved outward toward the right.

For reference a second fallboard contact point 1010 is shown overlaid on second white key 1004, second black key 1006, and third white key 1008. Second white key 1004 includes a first opening 1012 through which first capstan 641 extends, a second opening 1014 through which a first wire support of first back check 645 extends, a first anchor point 1016 indicates a point at which second capstan 648 is mounted to second key 634, and a second anchor point 1018 indicates a point at which back check 652 is mounted to second key 634. Second black key 1006 and third white key 1008 have similar openings.

Figure 11A:
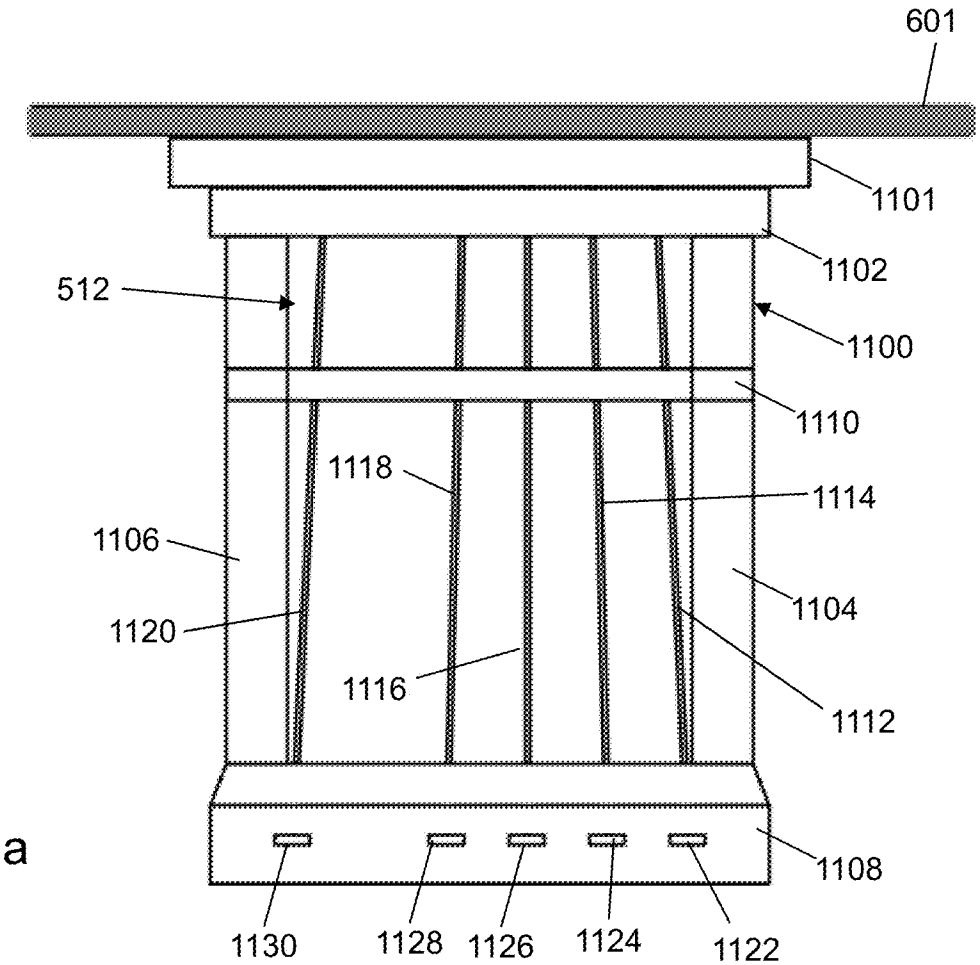
FIGS. 11*a*-11*b* depict front and side views of pedals of the double keyboard console of FIG. 5 in accordance with an illustrative embodiment.
Figure 11B:
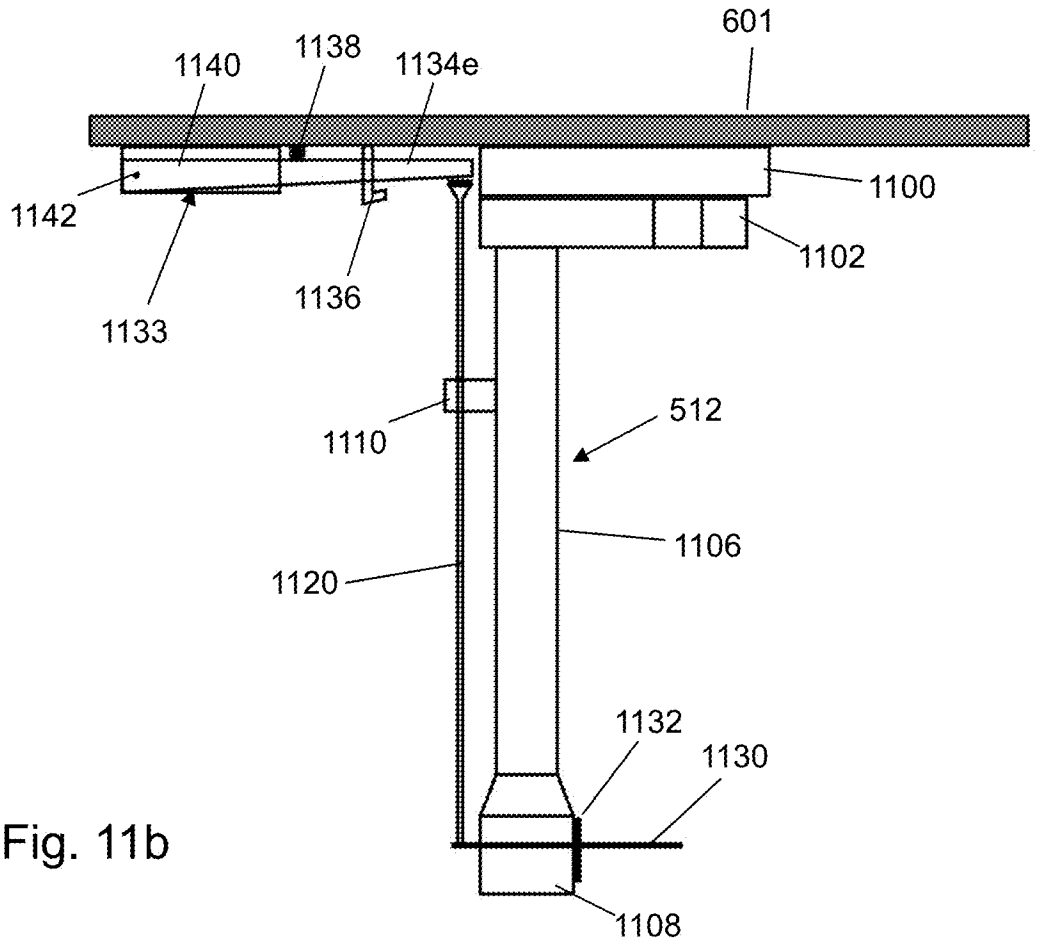

With reference to FIG. 11*a*, a front view of the plurality of pedals 512 of double keyboard console 108 is shown in accordance with an illustrative embodiment. With reference to FIG. 11*b*, a left side view of the plurality of pedals 512 of double keyboard console 108 is shown in accordance with an illustrative embodiment. The plurality of pedals 512 are not connected to first keyboard 116 or second keyboard 118. Instead, each of the plurality of pedals 512 pushes on a spring-loaded trapwork suspended from an underside of key bed 601 and associated with each of the plurality of pedals 512 is a sensor that mounts at a back of a pedal lyre.

In the illustrative embodiment, the plurality of pedals 512 include a first pedal 1122, a second pedal 1124, a third pedal 1126, a fourth pedal 1128, and a fifth pedal 1130 that are mounted to a frame 1100. The front of each pedal of the plurality of pedals 512 is shown in FIG. 11*a*. First pedal 1122 may be used by the pianist as a damper pedal. Second pedal 1124 may be used by the pianist as a sostenuto pedal. Third pedal 1126 may be used by the pianist as a coupler pedal. Fourth pedal 1128 may be used by the pianist as an una corda pedal. Fifth pedal 1130 may be used by the pianist as a control pedal.

In an illustrative embodiment, each pedal is a standard component. First pedal 1122 may flare to the right. Fourth pedal 1128 and fifth pedal 1130 may flare to the left. Third pedal 1126 and fourth pedal 1128 may be generally straight. A locking mechanism may be associated with one or more of the plurality of pedals 512. For example, a locking mechanism may be associated with second pedal 1124, third pedal 1126, and fourth pedal 1128. As discussed previously, in an illustrative embodiment, where first automatic player piano 102 and/or second automatic player piano 104 comprise a grand piano, the plurality of controlled pedals 212 include the una corda pedal, the sostenuto pedal, and the damper pedal. In an illustrative embodiment, first pedal 1122, second pedal 1124, and fourth pedal 1128 control the operation of the respective damper pedal, sostenuto pedal, and una corda pedal of first automatic player piano 102 and/or second automatic player piano 104.

In an illustrative embodiment, the distance from the right-most edge of double keyboard console 108 to first pedal 1122 is similar to a normal value of approximately 26 inches because the damper pedal is the most used pedal. Similarly, in an illustrative embodiment, the distance between each pedal and its adjacent pedals, except for fifth pedal 1130, may be the same as on a normal piano, approximately 2.5 inches center to center. In an illustrative embodiment, the distance between fourth pedal 1128 and fifth pedal 1130 may be approximately twice that distance or approximately 5 inches center to center.

Frame 1100 may include a bottom bridge 1101, a lyre top block 1102, a first lyre pillar 1104, a second lyre pillar 1106, a lyre box 1108, a lyre rod guide 1110, a first lyre rod 1112, a second lyre rod 1114, a third lyre rod 1116, a fourth lyre rod 1118, a fifth lyre rod 1120, a pedal plate 1132, and a trapwork mechanism 1133. A plurality of lyre sticks (not shown) may be mounted to the underside of key bed 601 to provide additional support for frame 1100.

Bottom bridge 1101 is mounted to the underside of key bed 601. Bottom bridge 1101 may have a variety of shapes and sizes selected to support lyre top block 1102. In an illustrative embodiment, a front edge of bottom bridge 1101 is positioned along a line approximately 8 inches from a front of key bed 601, and a right edge is positioned along a line approximately 20 inches from a right edge of key bed 601.

Lyre top block 1102 is mounted to bottom bridge 1101. In an illustrative embodiment, a back edge of lyre top block 1102 may align along the back edge of bottom bridge 1101, and a right edge of lyre top block 1102 may be offset approximately 1.25 inches from the right edge of bottom bridge 1101. First lyre pillar 1104 is mounted near the right edge of lyre top block 1102. Second lyre pillar 1106 is mounted near a left edge of lyre top block 1102. Lyre box 1108 is mounted to first lyre pillar 1104 on a right side and to second lyre pillar 1106 on a left side and includes a slot for each of the plurality of pedals 512. Lyre rod guide 1110 is mounted between first lyre pillar 1104 and second lyre pillar 1106 and includes holes to accommodate first lyre rod 1112, second lyre rod 1114, third lyre rod 1116, fourth lyre rod 1118, and fifth lyre rod 1120.

First lyre rod 1112 is mounted at a first end to a first trapwork 1134*a* and at a second end to a back edge of first pedal 1122. Second lyre rod 1114 is mounted at a first end to a second trapwork 1134*b* and at a second end to a back edge of second pedal 1124. Third lyre rod 1116 is mounted at a first end to a third trapwork 1134*c* and at a second end to a back edge of third pedal 1126. Fourth lyre rod 1118 is mounted at a first end to a fourth trapwork 1134*d* and at a second end to a back edge of fourth pedal 1128. Fifth lyre rod 1120 is mounted at a first end to a fifth trapwork 1134*e* and at a second end to a back edge of fifth pedal 1130. In an illustrative embodiment, first lyre rod 1112, second lyre rod 1114, third lyre rod 1116, fourth lyre rod 1118, and fifth lyre rod 1120 have a height of approximately 21 inches and may be angled to align appropriately with the holes of lyre rod guide 1110.

A plurality of sensors, one for each lyre rod, may be positioned to detect movement of first lyre rod 1112, second lyre rod 1114, third lyre rod 1116, fourth lyre rod 1118, and fifth lyre rod 1120, resulting in a stream of data to processor 508 that can be processed by processor 508 and sent through communication interface 506 to controller 106 and/or first automatic player piano 102 and second automatic player piano 104. In an illustrative embodiment, the plurality of sensors may be Disklavier™ Mark 4 Pro sensors manufactured by Yamaha Corporation. In an illustrative embodiment, the plurality of sensors are optical sensors though other types of sensors such as strain gauges may be used to detect the movement.

Pedal plate 1132 mounts to a front of lyre box 1108 and includes a slot for each of first pedal 1122, second pedal 1124, third pedal 1126, fourth pedal 1128, and fifth pedal 1130. In an illustrative embodiment, a locking mechanism is provided for each of second pedal 1124, of third pedal 1126, and of fourth pedal 1128 so that the pedal can be kept in the down position indefinitely, or until the pianist gives the pedal an extra downward squeeze. For example, each of second pedal 1124, of third pedal 1126, and of fourth pedal 1128 may be capped with a spring-loaded lock that can be pushed by the pianist's toe into associated slots in pedal plate 1132 to engage the locking mechanism. A subsequent downward tap on the engaged pedal releases the spring out of its slot to release the pedal. The plurality of sensors may be configured to further detect engagement of the locking mechanisms.

In an illustrative embodiment, trapwork mechanism 1133 may include a plurality of trapwork blocks 1140 and a plurality of trapworks. In an illustrative embodiment, the plurality of trapwork blocks 1140 includes seven trapwork blocks. A trapwork block is positioned to the left of fifth pedal 1130, to the right of first pedal 1122, between first pedal 1122 and second pedal 1124, between second pedal 1124 and third pedal 1126, between third pedal 1126 and fourth pedal 1128, and two trapwork blocks are positioned between fourth pedal 1128 and fifth pedal 1130 due to the increased spacing between these pedals. A back edge of each trapwork block of the plurality of trapwork blocks 1140 may be positioned approximately 1 inch from the back edge of key bed 601.

First trapwork 1134*a*, second trapwork 1134*b*, third trapwork 1134*c*, fourth trapwork 1134*d*, and fifth trapwork 1134*e* may be standard components that are covered in felt to prevent noisy collisions between each trapwork and key bed 601. Associated with each of first trapwork 1134*a*, second trapwork 1134*b*, third trapwork 1134*c*, fourth trapwork 1134*d*, fifth trapwork 1134*e*, is a trapwork hook 1136 and a trapwork spring 1138. Trapwork hook 1136 is configured to prevent excessive motion when the lyre is off and the piano is being moved. Trapwork spring 1138 is mounted to the underside of key bed 601. The tension and positioning of each trapwork spring 1138 may be adjusted to create a normal feel in the absence of an actual, heavy mechanism within, for example, a standard grand piano.

In an illustrative embodiment, a first trapwork pivot pin 1142 is mounted between the trapwork blocks on either side of fifth pedal 1130 to allow rotation of fifth trapwork 1134*e* about first trapwork pivot pin 1142 under control of fifth pedal 1130. In an illustrative embodiment, a second trapwork pivot pin (not shown) is mounted between the remaining trapwork blocks to allow rotation of first trapwork 1134*a*, second trapwork 1134*b*, third trapwork 1134*c*, and fourth trapwork 1134*d*, about the second trapwork pivot pin under control of the respective pedal 1122, 1124, 1126, 1128.

Third pedal 1126 and fifth pedal 1130 may be used to control a relationship between the keys activated on first automatic player piano 102 and those played by the pianist using first keyboard 116 and/or second keyboard 118, and the keys activated on second automatic player piano 104 and those played by the pianist using second keyboard 118 and/or first keyboard 116. Additionally, third pedal 1126 and fifth pedal 1130 may be used to control a relationship between the pedals of the plurality of pedals 212 that are activated on first automatic player piano 102 and/or on second automatic player piano 104. In an illustrative embodiment, when electronic components 514 are powered on and start up, as understood by a person of skill in the art, first automatic player piano 102 may by default be controlled to play the same keys as those played by the pianist using first keyboard 116. Second automatic player piano 104 may by default be controlled to play keys transposed up one octave from those played by the pianist using second keyboard 118. If the pianist depresses third pedal 1126, first automatic player piano 102 may be controlled to play both the same keys as those played by the pianist using first keyboard 116 and the keys transposed up one octave. The keys played by second automatic player piano 104 may be unaffected by depression of third pedal 1126. Of course, other default behavior may be defined without limitation.

In an illustrative embodiment, while fifth pedal 1130 is down, the pianist may strike keys on either first keyboard 116 or second keyboard 118, but no keys are played on either first automatic player piano 102 or second automatic player piano 104. Instead, the keys that are played are analyzed by key identification application 410 executed by processor 408 and used to alter the future behavior of first automatic player piano 102 or second automatic player piano 104 and their respective plurality of controlled pedals 212.

If, with fifth pedal 1130 down, the pianist strikes a single note on first keyboard 116 in the range C16-C64, subsequent keystrokes on first keyboard 116 cause first automatic player piano 102 to produce notes transposed by different intervals. As understood by a person of skill in the art, A1 here refers to the lowest note of a standard piano keyboard, B♭ 2 refers to its immediate neighbor on the right, and so on through C 88 at the top of the keyboard. The key struck while fifth pedal 1130 is depressed represents the pitch that middle C henceforth produces. For example, if the pianist depresses A♭ 24 with fifth pedal 1130 down, first automatic player piano 102 may be controlled to play keys a major tenth lower than those played by the pianist using first keyboard 116. If no other keys are depressed during the period that fifth pedal 1130 is down, the behavior of second automatic player piano 104 relative to the notes played on second keyboard 118 are unchanged, as is the behavior of first automatic player piano 102 when third pedal 1126 is engaged.

If, with fifth pedal 1130 down, the pianist strikes a single note on second keyboard 118 in the range C16-C64, the behavior of second automatic player piano 104 relative to notes played on second keyboard 118 can be altered in an analogous way, producing various degrees of transposition on second automatic player piano 104.

If fifth pedal 1130 is depressed, and the pianist hits multiple notes on first keyboard 116, the effect of third pedal 1126 on first keyboard 116 may be changed. If, as an example, a particular F♯ major chord is hit with fifth pedal 1130 down, from that point forward hitting middle C with third pedal 1126 engaged may produce the same chord on first automatic player piano 102. Hitting other notes may produce the chord transposed by appropriate intervals. To restore third pedal 1126 to its default behavior, a selected one or more notes may be identified to trigger the default behavior again. For example, the pianist may play notes C40 and C52 concurrently with depression of fifth pedal 1130 to trigger the default behavior again.

If the pianist plays one or more notes on first keyboard 116, one or more notes on second keyboard 118, and depresses fifth pedal 1130 all at once, subsequent keystrokes on first keyboard 116 with third pedal 1126 down may produce one or more appropriately transposed notes on first automatic player piano 102, enhanced by additional, appropriately transposed note or notes on second automatic player piano 104 as well.

In an illustrative embodiment, playing a single key outside the C16-C64 range may cause activation of other special effects when fifth pedal 1130 is depressed. As a first example, the pianist playing B♭ 2 on first keyboard 116 when fifth pedal 1130 is depressed may reassign use of first pedal 1122, second pedal 1124, and fourth pedal 1128. For example, depression of first pedal 1122 may henceforth control the damper pedal on only first automatic player piano 102, depression of second pedal 1124 may henceforth control the damper pedal on only second automatic player piano 104, and depression of third pedal 1128 may henceforth control the una corda pedal of both first automatic player piano 102 and second automatic player piano 104.

As a second example, the pianist playing B3 on first keyboard 116 may reassign use of the first pedal 1122, second pedal 1124, and fourth pedal 1128 such that depression of first pedal 1122 may henceforth control the damper pedal on both first automatic player piano 102 and second automatic player piano 104, depression of second pedal 1124 may henceforth control the una corda pedal on only first automatic player piano 102, and depression of fourth pedal 1128 may henceforth control the una corda pedal on only second automatic player piano 104. As a third example, the pianist playing A1 on first keyboard 116 may restore the default behavior of first pedal 1122, second pedal 1124, and fourth pedal 1128. As a fourth example, the pianist playing C88 on first keyboard 116 may restore the default transpositions relative to both first keyboard 116 and second keyboard 118.

As should be clear from the above provided examples, key identification application 410 executing at controller 106 may be programmed to control a virtually endless set of transpositions between the notes played by first automatic player piano 102 and by second automatic player piano 104 under control of first keyboard 116, second keyboard 118, first pedal 1122, second pedal 1124, and fourth pedal 1128 using signals indicating depression of third pedal 1126 and fifth pedal 1130 during the playing of a composition to trigger changes in the transpositions and the control of the pedals at each of first automatic player piano 102 and second automatic player piano 104.

Figure 12:
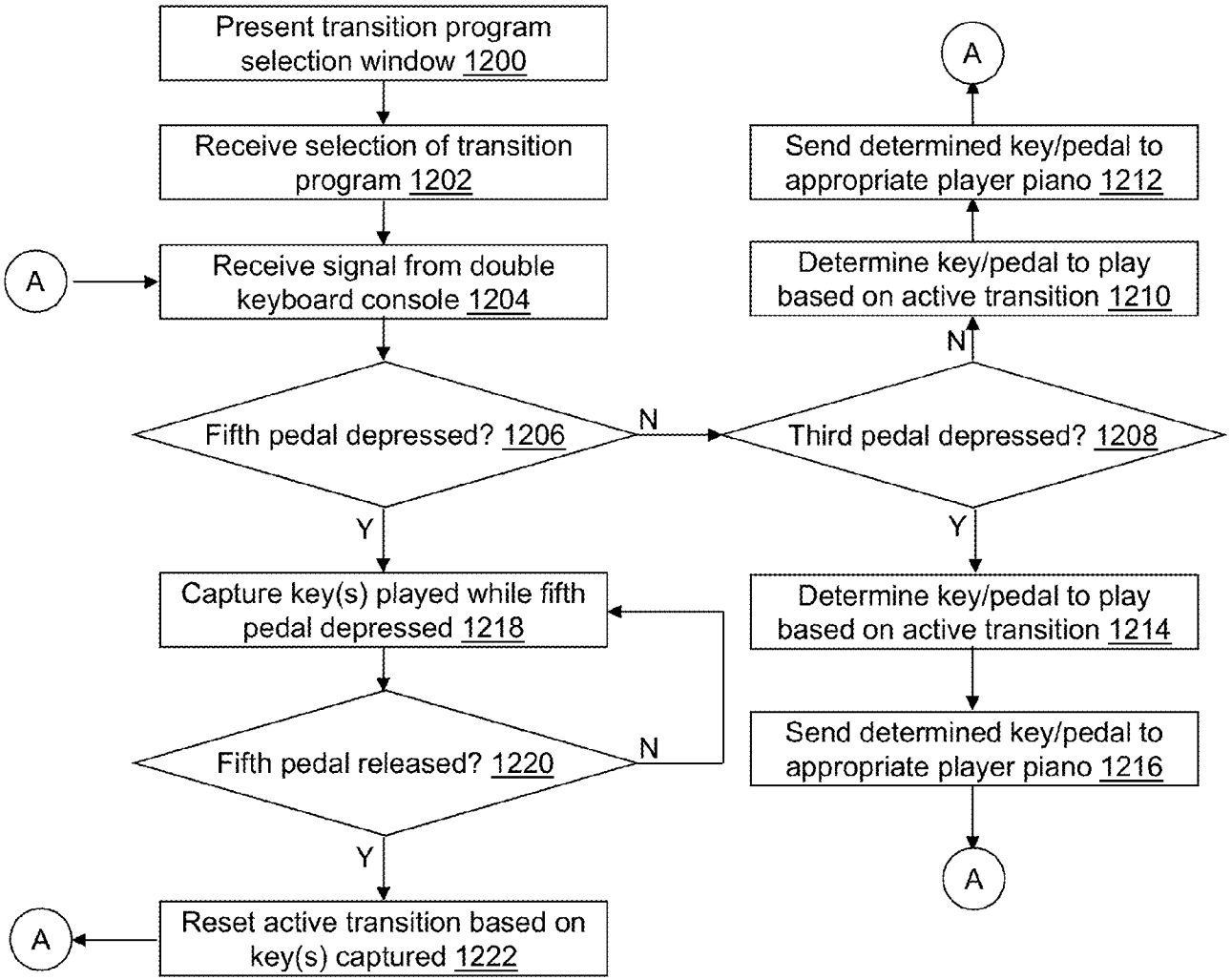
FIG. 12 depicts a flow diagram illustrating example operations performed through use of a double keyboard piano application of the automatic player piano of FIG. 2 in accordance with an illustrative embodiment.

With reference to FIG. 12, example operations associated with key identification application 410 are described. Of course, in another embodiment in which double keyboard piano system 100 does not include a controller 106, some or all of the operations associated with key identification application 410 may be integrated into control application 210 and/or key/pedal encoding application 510. Additional, fewer, or different operations may be performed depending on the embodiment. The order of presentation of the operations of FIG. 12 is not intended to be limiting. A user can interact with one or more user interface windows presented to the user in display 412 under control of key identification application 410 independently in an order selectable by the user. Thus, although some of the operational flows are presented in sequence, the various operations may be performed in various repetitions, concurrently, and/or in other orders than those that are illustrated. A user may execute key identification application 410 which causes presentation of a first user interface window, which may include a plurality of menus and selectors such as drop down menus, buttons, text boxes, hyperlinks, etc. associated with key identification application 410.

In an operation 1200, a transition program selection window is presented in display 412. In an operation 1202, a selection of a transition program to use is received. The transition program selection window for example may include a list of transition programs from which the user may select. The selected transition program defines the key(s)/pedal(s) to be played by first automatic player piano 102 and/or second automatic player piano 104 based on the key(s)/pedal(s) played by the pianist at double keyboard console 108 and the currently active transition logic. As discussed above, use of fifth pedal 1130 may cause the currently active transition logic to change. As an example, the selected transition program may include computer-readable and/or computer-executable instructions that provide for a translation between keys that have been played at double keyboard console 108 and those to actually play to create sound at first automatic player piano 102 and/or second automatic player piano 104. The selected transition program, for example, may include a lookup table indexed by the key(s) played when fifth pedal 1130 is depressed (operated) that defines a key translation as a constant shift or other mathematical shift. The currently active transition logic is the constant shift or other mathematical shift applied between keys.

In an operation 1204, a signal is received from double keyboard console 108 which includes information describing the keys played by the pianist using first keyboard 116 and/or second keyboard 118 and/or describing the pedal(s) of the plurality of pedals 512 depressed by the pianist.

In an operation 1206, a determination is made concerning whether or not the received information indicates that fifth pedal 1130 is being depressed by the pianist. If the determination is made that fifth pedal 1130 is not being depressed by the pianist, processing continues in an operation 1208. If the determination is made that fifth pedal 1130 is being depressed by the pianist, processing continues in an operation 1218.

In operation 1208, a determination is made concerning whether or not the received information indicates that third pedal 1126 is being depressed by the pianist. If the determination is made that third pedal 1126 is not being depressed by the pianist, processing continues in an operation 1210. If the determination is made that third pedal 1126 is being depressed by the pianist, processing continues in an operation 1214. In operation 1210, the key and/or pedal depressed is determined from the received information and the currently active transition logic is applied to determine the key and/or pedal to trigger at either first automatic player piano 102 and/or second automatic player piano 104. In an operation 1212, information including the determined key and/or pedal to trigger at either first automatic player piano 102 and/or second automatic player piano 104 is sent to the appropriate player piano, and processing continues at operation 1204 to process the next received signal.

In operation 1214, the key and/or pedal depressed is determined from the received information. The portion of the currently active transition logic that pertains to the intervals of transposition when third pedal 1126 is depressed is then applied to determine the key(s) and/or pedal to trigger at either first automatic player piano 102 and/or second automatic player piano 104. In an operation 1216, information including the determined keys to trigger at first automatic player piano 102 is sent to first automatic player piano 102, and processing continues at operation 1204 to process the next received signal.

In operation 1218, the key(s) depressed on first keyboard 116 and/or second keyboard 118 is captured. In an operation 1220, a determination is made concerning whether or not the received information indicates that fifth pedal 1130 is not being depressed by the pianist. If the determination is made that fifth pedal 1130 is not being depressed by the pianist, processing continues in an operation 1222. If the determination is made that fifth pedal 1130 is being depressed by the pianist, processing continues in operation 1218 to continue to capture the keys played while fifth pedal 1130 is depressed. In operation 1222, the key(s) depressed while fifth pedal 1130 was depressed is determined from the received information. The captured key(s) is compared, for example, to the lookup table. The transition logic associated with the captured key(s) is selected and the currently active transition logic is switched to the selected transition logic. Of course, if there is no match between the captured key(s) and the table entries, the currently active transition logic may not be switched. Processing continues at operation 1204 to process the next received signal.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A double keyboard piano system comprising:
a first automatic player piano;
a second automatic player piano; and
a double keyboard console including a first keyboard and a second keyboard mounted above the first keyboard,
wherein the first automatic player piano is in communication with the double keyboard console to receive a first signal including first information describing a first key for the first automatic player piano to automatically play based on a first key of the first keyboard being played,
wherein the second automatic player piano is in communication with the double keyboard console to receive a second signal including second information describing a second key for the second automatic player piano to automatically play based on a second key of the second keyboard being played;
wherein the first key has a first action mechanism, and further wherein a hammer of the first action mechanism strikes a sound absorbing structure.

2. The double keyboard piano system of claim 1, wherein the first automatic player piano is in communication with the double keyboard console to receive a third signal including third information describing a first pedal for the first automatic player piano to automatically operate based on a first pedal of the double keyboard console being operated.

3. The double keyboard piano system of claim 2, wherein the second automatic player piano is in communication with the double keyboard console to receive a fourth signal including fourth information describing a second pedal for the second automatic player piano to automatically operate based on the first pedal of the double keyboard console being operated.

4. The double keyboard piano system of claim 3, wherein the first pedal of the first automatic player piano causes a different musical effect than the second pedal of the second automatic player piano.

5. The double keyboard piano system of claim 1, wherein the first automatic player piano is in direct communication with the double keyboard console.

6. The double keyboard piano system of claim 1, further comprising a controller in communication with the double keyboard console and the first automatic player piano, wherein the first automatic player piano communicates with the double keyboard console through the controller.

7. The double keyboard piano system of claim 1, wherein the double keyboard console further includes a pedal and the first signal includes an indicator of operation of the pedal at the double keyboard console, wherein operation of the pedal causes the first automatic player piano to simultaneously play the described first key and a third key that is one octave above the described first key.

8. The double keyboard piano system of claim 7, wherein the double keyboard console further includes a sensor positioned and configured to detect operation of the pedal.

9. The double keyboard piano system of claim 8, wherein the double keyboard console further includes a communication interface configured to send the first signal to the first automatic player piano.

10. The double keyboard piano system of claim 1, wherein the double keyboard console further includes a sensor positioned and configured to detect playing of the first key of the first keyboard.

11. The double keyboard piano system of claim 10, wherein the double keyboard console further includes a communication interface configured to send the first signal to the first automatic player piano.

12. The double keyboard piano system of claim 1, wherein the second key is mounted above the first key, and the second key has a second action mechanism separate from the first action mechanism.

13. The double keyboard piano system of claim 1, wherein the double keyboard console does not produce musical sound separate from the sound the first automatic player piano and the second automatic player piano produce.

14. The double keyboard piano system of claim 1, wherein the described first key for the first automatic player piano is different than the first key played at the first keyboard.

15. The double keyboard piano system of claim 1, wherein the double keyboard console further comprises:
a sensor positioned and configured to detect playing of the first key;
a communication interface;
a processor; and
a computer-readable medium operably coupled to the processor, the computer-readable medium having computer-readable instructions stored thereon that, when executed by the processor, cause the double keyboard console
to receive an indicator from the sensor indicating that the first key has been played;
in response to receipt of the indicator, to create a message indicating that the first key has been played; and
to send the created message to the communication interface for transmission.

16. The double keyboard piano system of claim 15, further comprising a controller, wherein the controller comprises:
a second communication interface configured to receive the created message from the double keyboard console and to send the first signal;
a second processor; and
a second computer-readable medium operably coupled to the second processor, the second computer-readable medium having second computer-readable instructions stored thereon that, when executed by the second processor, cause the controller
to process the received message to determine that the first key has been played using the first keyboard;
to determine the first key for the first automatic player piano to automatically play based on an active transition logic and the determination that the first key has been played using the first keyboard;
to create a second message indicating that the first automatic player piano play the determined first key; and
to send the created second message to the second communication interface for transmission.

17. The double keyboard piano system of claim 16, wherein the double keyboard console further comprises a pedal and a sensor positioned and configured to detect operation of the pedal, wherein one or more keys played while the pedal is operated are not played at either the first automatic player piano or the second automatic player piano.

18. The double keyboard piano system of claim 16, wherein the double keyboard console further comprises a pedal and a sensor positioned and configured to detect operation of the pedal, wherein one or more keys are played while the pedal is operated.

19. The double keyboard piano system of claim 18, wherein the one or more keys played while the pedal is operated are included in one or more messages sent to the controller.

20. The double keyboard piano system of claim 19, wherein the second computer-readable instructions further cause the controller to switch the active transition logic to a second transition logic indentified based on the one or more keys played while the pedal is operated.

* * * * *